US006027037A

United States Patent [19]

Murakami et al.

[11] Patent Number: 6,027,037

[45] Date of Patent: Feb. 22, 2000

[54] ACCUMULATOR FUEL INJECTION APPARATUS FOR INTERNAL COMBUSTION ENGINE

[75] Inventors: Masashi Murakami, Toyokawa; Tetsuya Toyao; Shuichi Matsumoto, both of Kariya, all of Japan

[73] Assignee: Denso Corporation, Kariya, Japan

[21] Appl. No.: 08/975,397

[22] Filed: Nov. 20, 1997

Related U.S. Application Data

[63] Continuation-in-part of application No. 08/759,632, Dec. 5, 1996, Pat. No. 5,839,661.

[30] Foreign Application Priority Data

| | | | |
|---|---|---|---|
| Dec. 5, 1995 | [JP] | Japan | 7-316370 |
| Nov. 21, 1996 | [JP] | Japan | 8-310470 |
| Nov. 25, 1996 | [JP] | Japan | 8-313328 |

[51] Int. Cl.[7] ..... F02M 47/02

[52] U.S. Cl. ..... 239/88; 239/96; 239/533.8; 251/36; 251/129.07; 251/129.16

[58] Field of Search ..... 239/88, 89, 96, 239/533.2, 533.8, 533.9; 251/36, 47, 129.07, 129.16

[56] References Cited

U.S. PATENT DOCUMENTS

| | | | |
|---|---|---|---|
| 4,566,416 | 1/1986 | Berchtold . | |
| 4,719,889 | 1/1988 | Amann et al. . | |
| 4,798,186 | 1/1989 | Gauser . | |
| 4,826,080 | 5/1989 | Ganser | 239/88 |
| 4,958,430 | 9/1990 | Grieb et al. | 29/888.02 |
| 4,993,636 | 2/1991 | Taue et al. | 239/88 X |
| 5,029,759 | 7/1991 | Weber | 239/533.2 X |
| 5,125,575 | 6/1992 | Iwanaga . | |
| 5,244,150 | 9/1993 | Ricco et al. . | |
| 5,464,156 | 11/1995 | Ricco et al. . | |
| 5,472,142 | 12/1995 | Iwanaga | 239/96 |
| 5,660,368 | 8/1997 | De Mathaeis et al. . | |
| 5,807,163 | 9/1998 | Perry | 451/36 |
| 5,839,662 | 11/1998 | Iwanaga | 239/88 |

FOREIGN PATENT DOCUMENTS

| | | |
|---|---|---|
| 0304747A1 | 3/1989 | European Pat. Off. . |
| 0740068A2 | 10/1996 | European Pat. Off. . |
| 778 411 A2 | 6/1997 | European Pat. Off. . |
| 62-203932 | 9/1987 | Japan . |
| 63-147966 | 6/1988 | Japan . |
| 2-294554 | 12/1990 | Japan . |
| 5-133296 | 5/1993 | Japan . |
| 6-229347 | 8/1994 | Japan . |
| 7-310622 | 11/1995 | Japan . |
| 09158811 | 6/1997 | Japan . |
| 2185530A | 7/1987 | United Kingdom . |

*Primary Examiner*—Andres Kashnikow
*Assistant Examiner*—Steven J. Ganey
*Attorney, Agent, or Firm*—Pillsbury Madison & Sutro LLP

[57] ABSTRACT

An accumulator fuel injection apparatus for an internal combustion engine is provided which includes a solenoid-operated fuel injector. The fuel injector includes a solenoid valve and a needle valve. The solenoid valve establishes and blocks fluid communication between a pressure control chamber supplied with fuel pressure from a fuel inlet and a drain passage formed in a valve body to change fuel pressure within the pressure control chamber, thereby bringing the needle valve into engagement with and disengagement from a spray hole. The fuel injector also has a first orifice disc and a second orifice disc installed within the valve body. The first orifice disc has formed therein a first orifice which provides a first flow resistance to fuel flowing from the fuel inlet into the pressure control chamber. Similarly, the second orifice disc has formed therein a second orifice which provides a second flow resistance smaller than the first flow resistance to the fuel flowing out of the pressure control chamber into the drain passage. The second orifice disc is disposed on the first orifice disc so that thicknesswise directions thereof coincide with each other.

14 Claims, 19 Drawing Sheets

DISPLACEMENT OF MOVABLE MEMBER
PRESSURE IN PRESSURE CONTROL CHAMBER
VALUE OPENING PRESSURE
VALUE CLOSING PRESSURE
DISPLACEMENT OF CONTROL PISTON
RATE OF INJECTION
INJECTION BEGINNING
INJECTION BEGINNING
INJECTION END
INJECTION END
TIME

ACCUMULATOR FUEL INJECTION APPARATUS FOR INTERNAL COMBUSTION ENGINE

This application is a continuation-in-part application of U.S. Ser. No. 08/759,632, filed Dec. 5, 1996, now U.S. Pat. No. 5,839,661.

BACKGROUND OF THE INVENTION

1. Technical Field

The present invention relates generally to an accumulator fuel injection apparatus equipped with a solenoid valve for injecting fuel stored within a common rail (i.e., surge tank) at a high pressure level into an internal combustion engine.

U.S. Pat. No. 4,798,186 to Ganser, issued on Jan. 17, 1989 and U.S. Pat. No. 5,660,368 to De Matthaeis et al., issued on Aug. 26, 1997 disclose electromagnetically controlled fuel injection systems designed to accumulate the fuel within a common rail under pressure through a high-pressure feed pump and inject the fuel into an internal combustion engine. These fuel injection systems use a fuel injector and a solenoid operated two-way valve. The fuel injector includes a pressure control chamber communicating with a high-pressure fuel passage. The two-way valve selectively establishes and blocks fluid communication between the pressure control chamber and a low-pressure chamber to control the fuel pressure acting on a needle valve of the fuel injector for opening and closing a spray hole.

Between the high-pressure fuel passage and the pressure control chamber, a first orifice is formed in a first orifice member to restrict the flow rate of fuel entering the pressure control chamber from the high-pressure fuel passage. A second orifice is also formed in a second orifice member between the pressure control chamber and the low-pressure chamber to restrict the flow rate of fuel flowing from the pressure control chamber to the low-pressure chamber when the solenoid operated two-way valve is opened. When a response rate of the solenoid operated two-way valve is not changed at valve closing and opening, fuel injection characteristics such as injection timing, injection quantity, and rate of injection almost depend upon the flow rate characteristics of the first and second orifices.

Of the fuel injection characteristics, the quantity of fuel at the injection beginning, at the injection end, and during an early part of injection is determined by a difference in flow rate of fuels flowing from the high-pressure fuel passage to the pressure control chamber and flowing from the pressure control chamber to the low-pressure chamber when the solenoid operated two-way valve is opened. The quantity of fuel flowing out of the fuel injector after termination of injection and an interval between a time when the rate of injection shows a peak value and termination of injection (hereinafter, referred to as an injection cut-off period) are determined by the flow rate of fuel flowing from the high-pressure fuel passage to the pressure control chamber after the solenoid operated two-way valve is turned off or closed. Therefore, in order to ensure desired injection characteristics, it is necessary to adjust the flow rate characteristics of the first and second orifices by replacing the first and second orifice plates.

Since the fuel injection characteristics such as the injection timing, the injection quantity, and the rate of injection are, as described above, almost determined based on the flow rate characteristics of the first and second orifices, they will be changed greatly depending upon the shape, sectional area, circularity, inlet dimension, outlet dimension, surface roughness of the first and second orifices.

The optimum fuel injection over a wide range of engine operation which limits the rate of injection at an early part of injection and stops the injection at a high response rate, requires finely drilling the first and second orifices to have a diameter of approximately $\phi$0.2 mm to $\phi$0.4 mm.

In the De Matthaeis et al. system (U.S. Pat. No. 5,660,368), the first and second orifices are formed in a single injector component. Thus, both the first and second orifices must be replaced even when it is required to change the flow rate characteristics of either of the first and second orifices for adjusting the injection timing and/or the injection characteristics at early and/or late part of injection. This leads to the problem that production yield of injector components for injection characteristic adjustment is decreased. Further, variations in machining accuracy in forming the first and second orifices may mutually affect, thereby making it more difficult to ensure the desired injection characteristics. This also increases the number of times the injector component is replaced until the desired injection characteristics are obtained in an injection characteristics adjustment process.

In the Ganser's system (U.S. Pat. No. 4,798,186), the first and second orifices are formed in different injector components and thus may be replaced separately for changing the flow rate characteristics. One of the injector components having formed therein either of the first and second orifices supports the other slidably. A clearance between sliding surfaces of the injector component pair having formed therein the first and second orifices is decreased as much as possible to facilitate sealing thereof for avoiding leakage of the high-pressure fuel out of the pressure control chamber. Therefore, replacement of only one of the injector component pair may result in an undesirable decrease in the clearance, thereby precluding the sliding motion of the injector components or in great increase in the clearance, thereby leading to the leakage of fuel.

SUMMARY OF THE INVENTION

It is therefore a principal object of the present invention to avoid the disadvantages of the prior art.

It is another object of the present invention to provide an improved structure of a fuel injector apparatus for an internal combustion engine which is designed to obtain desired injection characteristics in a simple and economical manner.

According to one aspect of the present invention, there is provided an accumulator fuel injection apparatus for injecting high-pressure fuel stored within a common rail into an internal combustion engine which comprises: (a) a valve body having formed therein a fuel inlet passage and a spray hole, fuel inlet passage communicating with the common rail; (b) a valve member disposed slidably within the valve body for selectively establishing and blocking fluid communication between the fuel inlet passage and the spray hole; (c) a pressure control chamber formed within the valve body, the pressure control chamber being connected to the fuel inlet passage to introduce therein fuel pressure which acts on the valve member to block the fluid communication between the fluid inlet passage and the spray hole; (d) a fuel pressure drain passage formed within the valve body, connected to the pressure control chamber for draining the fuel pressure out of the valve body; (e) a solenoid valve selectively establishing and blocking fluid communication between the pressure control chamber and the fuel pressure drain passage; (f) a first orifice plate having formed therein a first orifice which provides a first flow resistance to fuel flowing from the fuel inlet passage into the pressure control chamber; and (g) a second orifice plate having formed therein a second orifice which provides a second flow resistance smaller than the first flow resistance to the fuel flowing out of the pressure control chamber into the fuel pressure drain passage when the solenoid valve establishes the fluid communication between the pressure control chamber and the fuel pressure drain passage, the second orifice plate being disposed on the first orifice plate so that thicknesswise directions thereof coincide with each other.

In the preferred mode of the invention, the first orifice has a length extending in parallel to a thickness of the first orifice plate. The second orifice has a length extending in parallel to a thickness of the second orifice plate.

The first and second orifices are formed by drilling the first and second orifice plates and reaming drilled holes.

The first and second orifices may alternatively be machined in an electron discharge method.

The first and second orifices may also be polished by forcing an abrasive solution made of a mixture of liquid and abrasive grain therethrough until the flow of the abrasive solution through the first and second orifices reaches a given flow rate.

Each of the first and second orifice plates is made of a disc in which first and second through holes are formed. Two knock pins are inserted into the valve body through the first and second through holes of the first and second orifice plates to fix angular positions of the first and second orifice plates relative to the valve body.

The first and second through holes are formed at different intervals away from the center of each of the first and second orifice plates so that a line extending through the centers of the first and second through holes is offset from the center of each of the first and second orifice plates.

A first large-diameter hole which has a diameter greater than that of the first orifice may be formed in the first orifice plate coaxially with the first orifice in communication with the first orifice. A second large-diameter hole which has a diameter greater than that of the second orifice may also be formed in the second orifice plate coaxially with the first orifice in communication with the second orifice.

The first and second orifice plates are so disposed within the valve body that the first orifice plate is exposed at a first surface to the pressure control chamber and at a second surface opposite the first surface in contact with a first surface of the second orifice plate, and the second orifice plate is exposed at a second surface opposite the first surface to the fuel pressure drain passage. A cylindrical chamber is formed in the second surface of the second orifice plate in communication with the second orifice which has a diameter greater than that of the second orifice.

The solenoid valve includes a valve head which opens and closes the second orifice to establish and block the fluid communication between the pressure control chamber and the fuel pressure drain passage. An annular valve seat on which the valve head of the solenoid valve is to be seated to block the fluid communication between the pressure control chamber and the fuel pressure drain passage, is formed on the second surface of the second orifice plate around an opening of the cylindrical chamber.

An annular groove is formed in the second surface of the second orifice plate around the annular valve seat of the second orifice plate in fluid communication with the fuel pressure drain passage.

The cylindrical chamber may alternatively be formed in the valve head opening to the second orifice of the second orifice plate which has a diameter greater than that of the second orifice.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings:

FIG. 3(*b*) is a partially expanded view which shows a needle valve and a spray hole in FIG. 4;

FIG. 17(*b*) is a cross sectional view taken along the line B—B in FIG. 17(*a*);

FIG. 18(*b*) is a cross sectional view taken along the line B—B in FIG. 18(*a*);

FIG. 19(*b*) is a time chart which shows a variation in pressure within a pressure control chamber formed in the fuel injector in FIG. 13;

FIG. 19(*c*) is a time chart which shows a displacement of a control piston mounted in the fuel injector in FIG. 13;

FIG. 19(*d*) is a time chart which shows a variation in rate of injection;

FIG. 23(*b*) is a partial perspective view which shows first and second orifice plates of a fuel injector according to the seventh embodiment of the invention;

FIG. 24(*b*) is a partial perspective view which shows first and second orifice plates of a fuel injector according to the eighth embodiment of the invention.

DESCRIPTION OF THE PREFERRED EMBODIMENT

Figure 1:
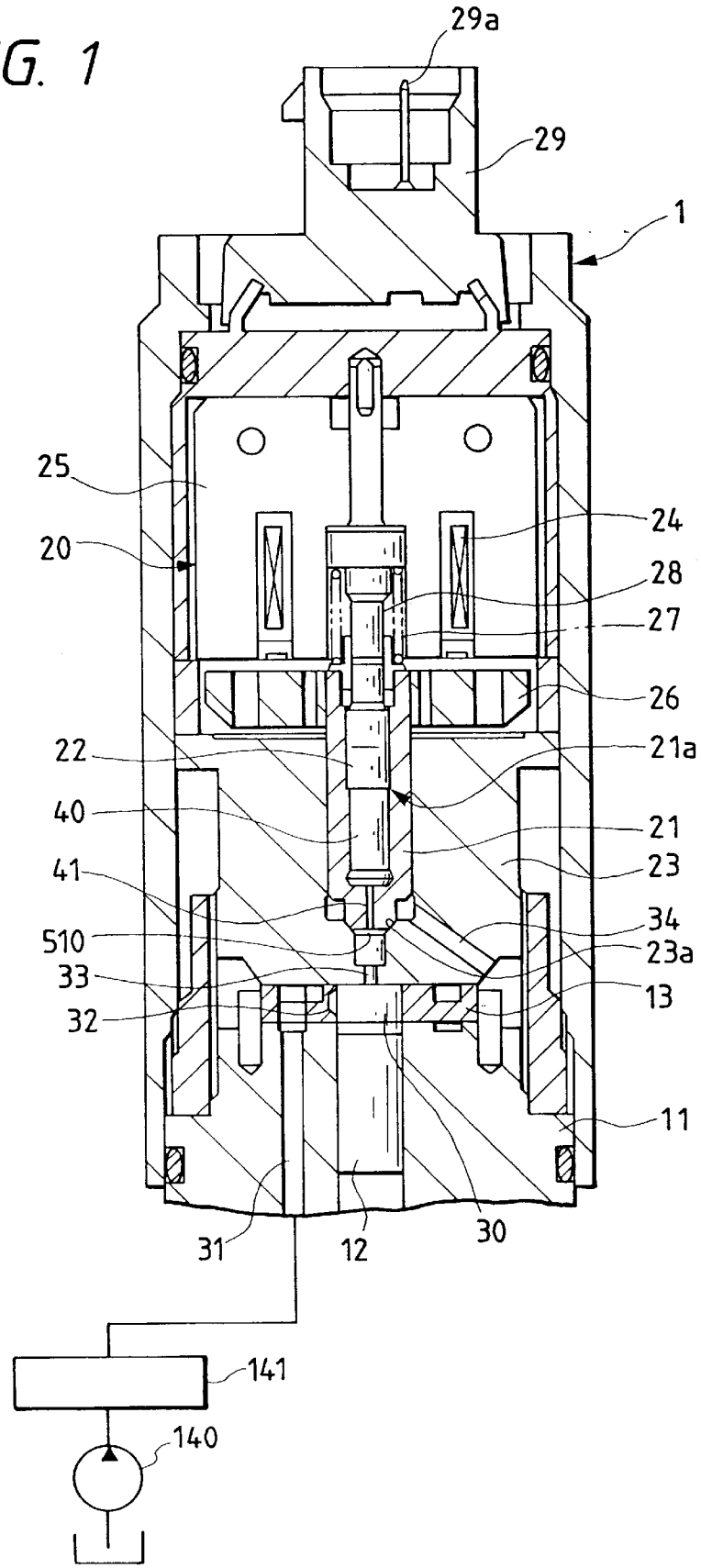
FIG. 1 is a partially cross-sectional view which shows a fuel injector of the first embodiment of the invention.

Referring now to the drawings, particularly to FIG. 1, there is shown a fuel injector for diesel engines with which a solenoid valve of the invention is used.

The control piston 12 which is connected to a needle valve is slidably disposed within the injector body 11. The pressure control chamber 30 is defined within the injector body 11 to which an upper end of the control piston 12 is exposed. The fuel pressurized in an accumulator chamber of the common rail 141 is supplied to the pressure control chamber 30 through the fuel supply passage 31 and the orifice 32. The fuel pressure within the pressure control chamber 30 acts on the control piston 12 in a direction of closing the spray hole of the fuel injector 1. The pressurized fuel supplied to the fuel supply passage 31 also flows to a fuel reservoir around the needle valve. The upward movement of the needle valve causes the fuel in the fuel reservoir to be sprayed from the spray hole.

The solenoid valve 20 is installed on the injector body 11 and has the valve 21 made of a hollow cylindrical member. The valve 21 is slidably disposed within the valve body 23 and urged by the spring 27 into constant engagement with the valve seat 23*a*. The pressure balancing chamber 40 is defined within the valve 21 by the balancing piston 21 and communicates with the pressure control chamber 30 through the flow restricting passage 41 formed in an end of the valve 21 and the flow restricting passage 33 formed in the valve body 23. When the valve 21 leaves the valve seat 23*a*, it will cause the pressurized fuel within the pressure control chamber 30 to flow to the fuel return passage 34 through the flow restricting passage 33 and then to, for example, a fuel tank through a fuel outlet (not shown) formed in the valve body 23.

Figures 2A, 2B, 2C, 2D:
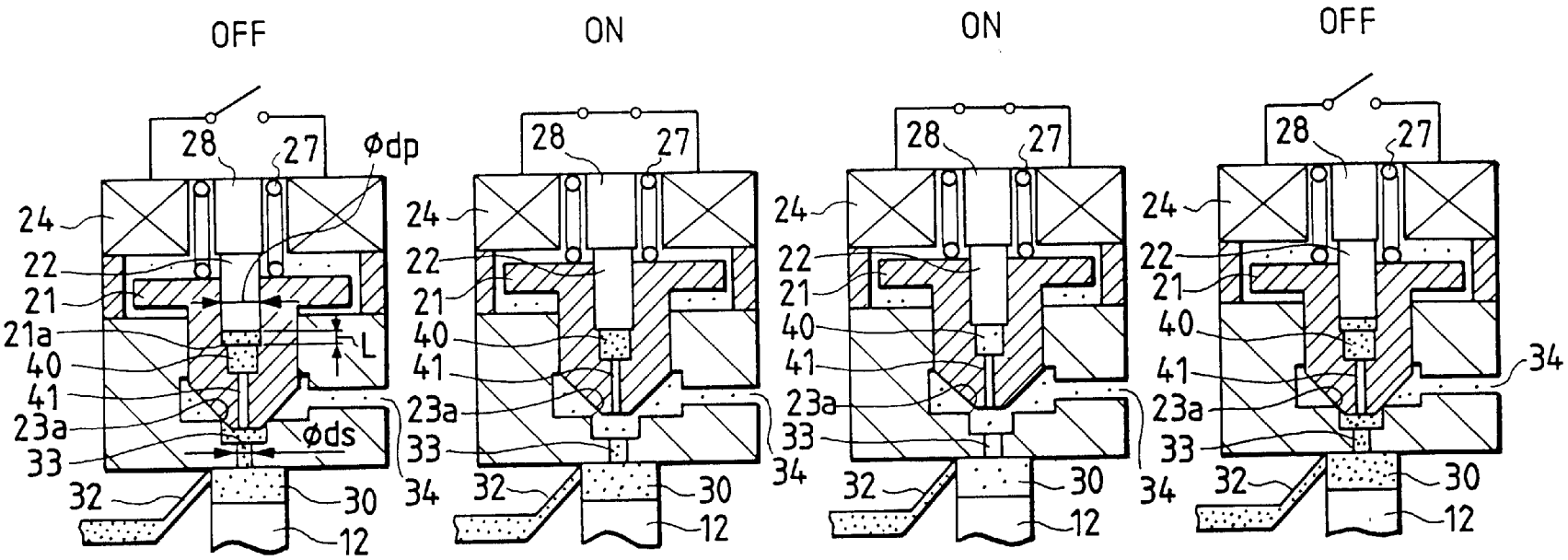
FIGS. 2(*a*) to 2(*d*) are partially cross-sectional views which show sequential operations of a solenoid valve disposed within the fuel injector of FIG. 1.

A cross-sectional area $\phi d_P$, as shown in FIG. 2(*a*), of the balancing piston 22 and a seat area $\phi d_S$ of a head of the valve 21 are substantially equal to each other. In other words, the force produced by the fuel pressure from the pressure control chamber 30 acting on a pressure-energized surface 510, as shown in FIG. 1, of the valve 21 in a valve lifting direction when the valve 21 is seated on the valve seat 23*a* is nearly balanced with the force produced by the fuel pressure in the pressure balancing chamber 40 urging the valve 21 into engagement with the valve seat 23*a*. Since the fuel pressure acting on pressure-energized surfaces of the valve 21 other than the pressure-energized surface 510 is much smaller than the fuel pressures in the pressure control chamber 30 and the pressure balancing chamber 40, the forces acting on the valve 21 in valve-opening and -closing directions may be considered to be equal to each other. Therefore, it is possible to decrease the spring force of the spring 27 required for seating the valve 21 on the valve seat 23*a* as compared with a conventional type. It is also possible to decrease the attracting force produced by the coil 24 of the solenoid valve 20 lifting the valve 21 upward against the spring force of the spring 27. This allows the size of an overall structure of the solenoid valve 20 to be reduced.

Figure 3A:
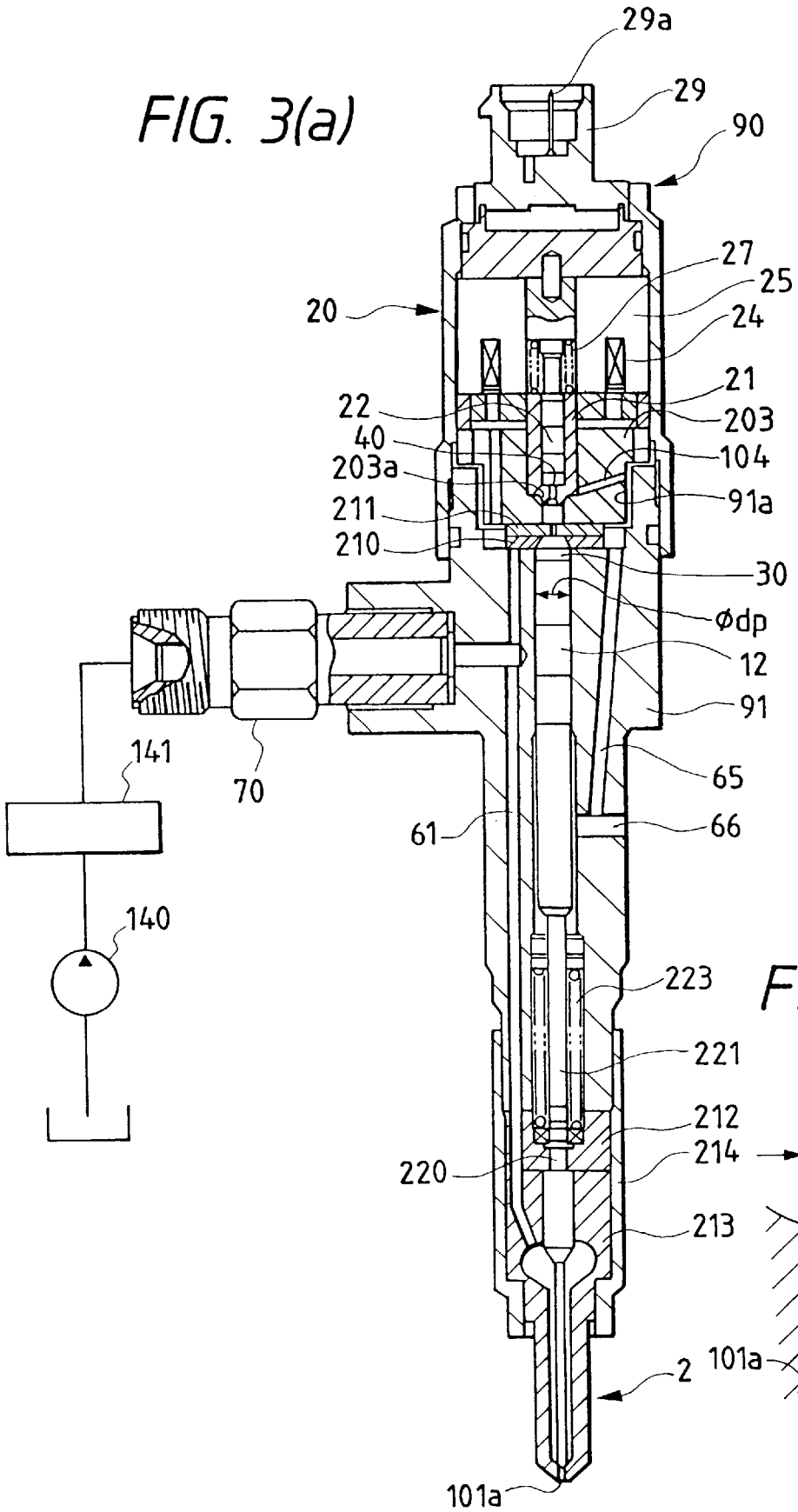
FIG. 3(*a*) is a cross-sectional view which shows a fuel injector of the second embodiment of the invention.
Figure 3B:
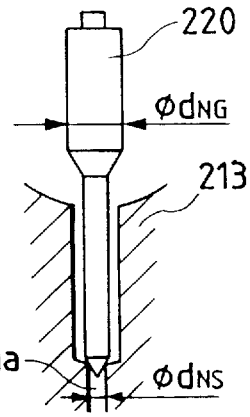

The balancing piston 22 is slidably disposed within the valve 21 in liquid-tight engagement with an inner wall of the valve 21. The inner wall of the valve 21 has formed thereon the shoulder portion 21*a*, as viewed in FIGS. 2 and 3(*a*). When the valve 21 is lifted upward, the balancing piston 22 engages the shoulder portion 21*a*, thereby restricting further upward movement of the valve 21. Upon start of an engine, the pressurized fuel is supplied from the common rail 141 to the fuel injector 1 through the fuel supply passage 31 to move the balancing piston 22 upward a distance L, as shown in FIG. 3(*a*), into engagement with the stopper 28.

The solenoid valve 20 includes the coil 24 made of wire wound within an annular groove formed in the core 25. Pulses are applied to the coil 24 through the pin 29*a* of the connector 29 from a controller (not shown). When the coil 25 is energized, it produces magnetic attraction to draw the valve 21 along with the armature 26 against the spring force of the spring 27, thereby causing the valve 21 to leave the valve seat 23*a*.

The operation of the fuel injector 1 will be discussed below with reference to FIGS. 1 and 2(*a*) to 2(*d*). In FIGS. 2(*a*) to 2(*d*), the density of dots indicates the level of fuel pressure, and a higher density of dots indicates a higher level of the fuel pressure.

When the coil 24 is in an off position as shown in FIG. 2(*a*), the valve 21 is seated on the valve seat 23*a*, blocking the fluid communication between the pressure control chamber 30 and the fuel return passage 34 so that the fuel pressures in the pressure control chamber 30 and the pressure balancing chamber 40 are maintained at high levels. The forces produced by the fuel pressures acting on the valve 21 in the valve-opening direction and the valve-closing direction are, as mentioned above, substantially equal to each other.

When the coil 24 is energized, the valve 21 leaves, as shown in FIG. 2(*b*), the valve seat 23*a* to establish the fluid communication between the pressure control chamber 30 and the fuel return passage 34. Since a flow area of the flow restricting passage 33 is greater than that of the orifice 32, the fuel pressure within the pressure control chamber 30 is decreased. This decrease in fuel pressure causes the needle valve to be lifted up along with the control piston 12 so that the fuel is sprayed from the spray hole.

The flow rate of fuel within the pressure balancing chamber 40 flowing to the low-pressure side (i.e., the fuel return passage 34) is restricted by the throttling passage 41, so that the fuel pressure in the pressure balancing chamber 40 is decreased more gradually than that in the pressure control chamber 30. Thus, immediately after the coil 24 is energized as shown in FIG. 2(*b*), the fuel pressure within the pressure balancing chamber 40 is maintained at a higher level than that on the low-pressure side.

The pulse width supplied to the coil 24 during normal fuel injection control is greater than that during small fuel injection quantity control. Thus, during the energization of the coil 24 as shown in FIG. 2(*c*), the fuel within the pressure balancing chamber 40 flows to the fuel return passage 34 against the flow resistance of the flow restricting passage 41, so that the fuel pressure within the pressure balancing chamber 40 will become equal to that on the low-pressure side.

Subsequently, when the coil 24 is deenergized as shown in FIG. 2(*d*), it will cause only the spring force of the spring 31 to urge the valve 21 slowly into engagement with the valve seat 23*a* to block the fluid communication between the pressure balancing chamber 40 and the fuel return passage 34. This elevates the fuel pressure within the pressure control chamber 30 to move the control piston 12 downward, thereby moving the needle valve in the valve-closing direction to stop the fuel injection.

Since time intervals at which the solenoid valve 20 is turned on and off during the normal fuel injection control are, as discussed above, longer than those during the small fuel injection quantity control, the low-speed engagement of the valve 21 with the valve seat 23*a* does not impinge on the fuel injection quantity and injection timing control.

Conversely, since the width of the pulse supplied to the coil 24 during the small fuel injection quantity control is smaller than that during the normal fuel injection control shown in FIG. 2(*c*), the fuel pressure within the pressure balancing chamber 40 is maintained higher than that on the low-pressure side, similar to the one shown in FIG. 2(*b*), even immediately before the coil 24 is turned off due to the flow resistance of the flow restricting passage 41. Therefore, when the coil 24 is changed from the on position to off position at a very short time interval, it will cause the difference in pressure between the pressure balancing chamber 40 and the low-pressure side to urge the valve 21 toward the valve seat 23*a*. This pressure plus the spring force of the spring 27 urges the valve 21 into engagement with the valve seat 23*a* quickly when the coil 24 is turned off even if the residual magnetic flux remains in the coil 24, thereby resulting in a rapid rise in fuel pressure in the pressure control chamber 30.

Immediately before the coil 27 is changed from the off position to the on position at a very short time interval in the small fuel injection quantity control, the flow rate of fuel flowing from the pressure control chamber 30 to the pressure balancing chamber 40 is restricted by the flow resistance of the flow restricting passage 41, so that the fuel pressure in the pressure control chamber 30 is, as shown in FIG. 2(*d*), higher than that in the pressure balancing chamber 40. Specifically, the pressure difference between the pressure control chamber 30 and the pressure balancing chamber 40 urges the valve 21 upward. When the coil 24 is turned on from this condition, it will cause the pressure difference between the pressure control chamber 30 and the pressure balancing chamber 40 as well as the attracting force of the coil 24 to urge the valve 21 upward so that it leaves the valve seat 23*a* quickly, resulting in rapid decrease in fuel pressure in the pressure control chamber 30, thereby lifting up the needle valve along with the control piston 12. This achieves a high-speed fuel spray operation in response to turning on of the coil 24.

Therefore, even when the coil 24 is turned on and off cyclically at short time intervals under the small fuel injection quantity control, the fuel pressure in the pressure balancing chamber 40 acts on the valve 21 both in the valve-opening direction and in the valve-closing direction properly, thereby achieving high-speed valve opening and closing operations.

Figure 4:
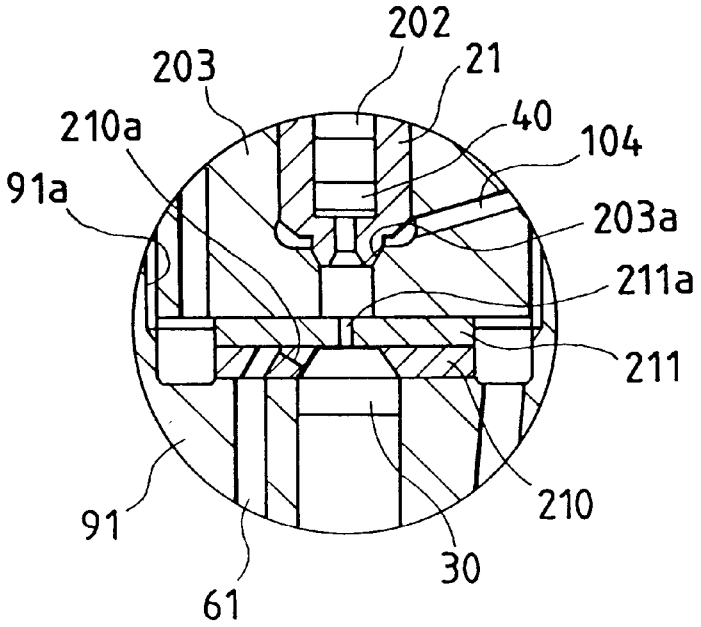
FIG. 4 is a partially enlarged sectional view of FIG. 3(*a*)

FIGS. 3 and 4 shows the second embodiment of the fuel injector of the invention. The same reference numbers as employed in the above first embodiment refer to the same parts, and explanation thereof in detail will be omitted here.

The fuel injector 90 has the two-port solenoid valve 20 as clearly shown in FIG. 3. The solenoid valve 20 includes the valve 21 and the balancing piston 22. The valve 21 is disposed slidably within the valve body 203 and has formed therein the pressure balancing chamber 40. The balancing piston 22 is slidably disposed within the pressure balancing chamber 40 in liquid-tight engagement with an inner wall of the pressure balancing chamber 40. The pressure balancing chamber 40 communicates with the pressure control chamber 30. When a head of the valve 21 is seated on the valve seat 203*a*, it blocks fluid communication of the pressure balancing chamber 40 and the pressure control chamber 30 with the fuel return passage 104 which is connected to the fuel outlet 66 through the fuel return passage 65. The fuel outlet 66 is connected to, for example, a fuel tank.

The needle valve 220 is slidably disposed within the nozzle body 213 of the spray nozzle 2 for opening and closing the spray hole 101*a*. The nozzle body 213 and the injector body 91 are joined by the retaining nut 214 through the distance piece 212. The pressure pin 221 is disposed between the pressure control piston 12 and the needle valve 220 and inserted into the spring 223. The pressure pin 221 may be secured to the pressure control piston 12 using a pin or press-fit or welding manner. The spring 223 urges the pressure pin 221 downward, as viewed in the drawing. The pressurized fuel is supplied from the common rail 141 connected to the fuel pump 140 to the fuel supply passage 61 through the fuel inlet 70. When the needle valve 220 is lifted up, the pressurized fuel within the fuel supply passage 61 is sprayed from the spray hole 101*a* of the spray nozzle 2.

A circular recessed portion 91*a* is formed in an upper end of the injector body 91 which has formed on an inner wall thereof internal threads meshing with external threads formed on an outer wall of the valve body 203. This allows the length of the fuel injector 90 to be decreased as compared with a conventional type. The fuel injector 90 may thus be used with an engine wherein an injector-mounting space is small. The circular recessed portion 91*a* may alternatively be formed in the valve body 203 for tight engagement with the injector body 91. Similar arrangements may also be used when a three-port solenoid valve is employed.

Disposed between the injector body 91 and the valve body 203 are, as shown in FIG. 4, the first flow restricting plate 210 and the second flow restricting plate 211. The first flow restricting plate 210 has formed therein the inlet orifice 210*a* which restricts fuel flow from the fuel supply passage 61 to the pressure control chamber 30. The second flow restricting plate 211 has formed therein the outlet orifice 211*a* which restricts fuel flow from the pressure control chamber 30 to the pressure return passage 104 and which has an flow area (i.e., a cross-sectional area) greater than that of the inlet orifice 210*a*. The injector body 91, the first flow restricting plate 210, the second flow restricting plate 211, and the valve body 203 are, as apparent from the drawing, designed to be joined together in flat surface. It is thus easy to machine each element.

In operation, when the coil 24 of the solenoid valve 20 is in the off position, the valve 21 is seated on the valve seat 203*a* as shown in FIG. 4, blocking the fluid communication of the pressure control chamber 30 and the pressure balancing chamber 40 with the fuel return passage 104 so that the fuel pressures within the pressure control chamber 30 and the pressure balancing chamber 40 are maintained at high levels. The pressures or forces urging the valve 21 in the valve-opening and -closing directions are, as described above, substantially equal to each other.

When the coil 24 is turned on, it will cause the valve 21 to leave the valve seat 203*a* to establish the fluid communication of the pressure control chamber 30 and the pressure balancing chamber 40 with the fuel return passage 104. Since the flow area of the outlet orifice 211*a* is, as described above, greater than that of the inlet orifice 210*a*, the fuel pressure within the pressure control chamber 30 is decreased, thereby causing the needle valve 220 to be lifted up along with the control piston 12 to spray the fuel from the spray nozzle 2.

If the diameter of the control piston 12, as clearly shown in FIG. 3(*a*), is defined as $d_P$, the diameter of a guide hole formed in the nozzle body 213 in which the needle valve 220 is moved up and down in liquid-tight engagement (i.e., the diameter of a large-diameter portion of the needle valve 220 as shown in FIG. 3(*b*)) is defined as $d_{NG}$, the diameter of a seat area of a head of the needle valve 220 exposed to the spray hole 101*a* (identical with the diameter of the spray hole 101*a* in this embodiment) is defined as $d_{NS}$, the fuel pressure supplied from the common rail 141 to the fuel injector 90 is defined as $P_C$, and the valve-opening pressure required for lifting up the needle 220 to open the spray hole 101*a* of the spray nozzle 2 is defined as $P_O$, then the pressure $P_{CC1}$ within the pressure control chamber 30 when lifting up the needle valve 220 along with the control piston 12 for initiating the fuel injection is $$P_{CC1}=(d_{NG}^2-d_{NS}^2)\times(P_C-P_O)/d_P^2 \quad (1)$$

where the valve-opening pressure $P_O$ represents the fuel pressure required for lifting up the needle valve 220 when the pressure within the pressure control chamber 30 is ignored. In the equation (1), $(d_{NG}^2-d_{NS}^2)/d_P^2$ corresponds to (a pressure-energized area of the needle valve 220 on which the fuel pressure supplied from the fuel supply passage 61 acts in the lengthwise direction of the fuel injector 90)/(a pressure-energized area of the control piston 12 on which the fuel pressure within the pressure control chamber 30 acts in a lengthwise direction of the fuel injector 90). Thus, if the pressure-energized area of the needle valve 220 is defined as $A_N$, and the pressure-energized area of the control piston 12 is defined as $A_Q$, the equation (1) may be rewritten as follows:

$$P_{CC1}=A_N\times(P_C-P_O)/A_Q \quad (1.1)$$

The spring force $F_S$ of the spring 223 is expressed using the valve-opening pressure $P_O$, the diameter $d_{NG}$ of the needle valve 220, and the seat diameter $d_{NS}$ of the needle valve 220 as follows:

$$F_S=(\pi/4)\times(d_{NG}^2-d_{NS}^2)\times P_O \quad (2)$$

From the above equation (2), the valve-opening pressure $P_O$ may be determined. In this embodiment, $d_{NG}$=4 mm, $d_{NS}$=2.25 mm, dp=5 mm, $F_S$=10.3 kg, and $P_O$=120 kgf/cm$^2$.

Figure 5:
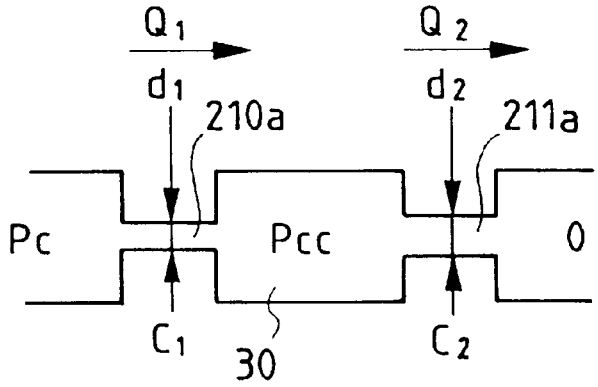
FIG. 5 is an illustration which shows a change in pressure of fuel passing through an inlet orifice and an outlet orifice.
Figure 6:
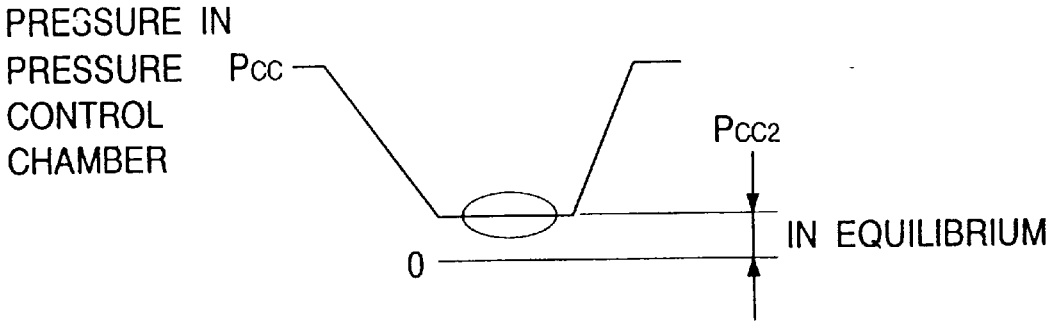
FIG. 6 is a graph which shows a variation of pressure $P_{CC}$ within a pressure control chamber.

When the valve 21 leaves the valve seat 203*a*, the flow rate of fuel entering the pressure control chamber 30 is balanced with that flowing out of the pressure control chamber 30. If the flow rate of fuel passing through the inlet orifice 210*a* is, as shown in FIG. 5, defined as $Q_1$, the flow coefficient of the inlet orifice 210*a* is defined as $C_1$, the flow rate of fuel passing through the outlet orifice 211*a* is defined as $Q_2$, and the flow coefficient of the outlet orifice 211*a* is defined as $C_2$, in a steady state, as shown in FIG. 6, wherein the pressure $P_{CC}$ within the pressure control chamber 30 reaches the constant minimum pressure $P_{CC2}$ as represented by the equation (3) below, then $Q_1$ will be equal to $Q_2$.

$$C_1\times d_1^2\times(P_C-P_{CC2})^{1/2}=C_2\times d_2^2\times P_{CC2}^{1/2} \quad (3)$$

where $d_1$ is the diameter of the inlet orifice 210*a*, and $d_2$ is the diameter of the outlet orifice 211*a*. If $C_1=C_2$, then $P_{CC2}$ is given by the equation (4) below and changes depending upon a value of $d_2/d_1$ as well as a value of the supplied fuel pressure $P_C$.

$$P_{CC2}=P_C/\{1+(d_2/d_1)^4\} \quad (4)$$

Figure 7:
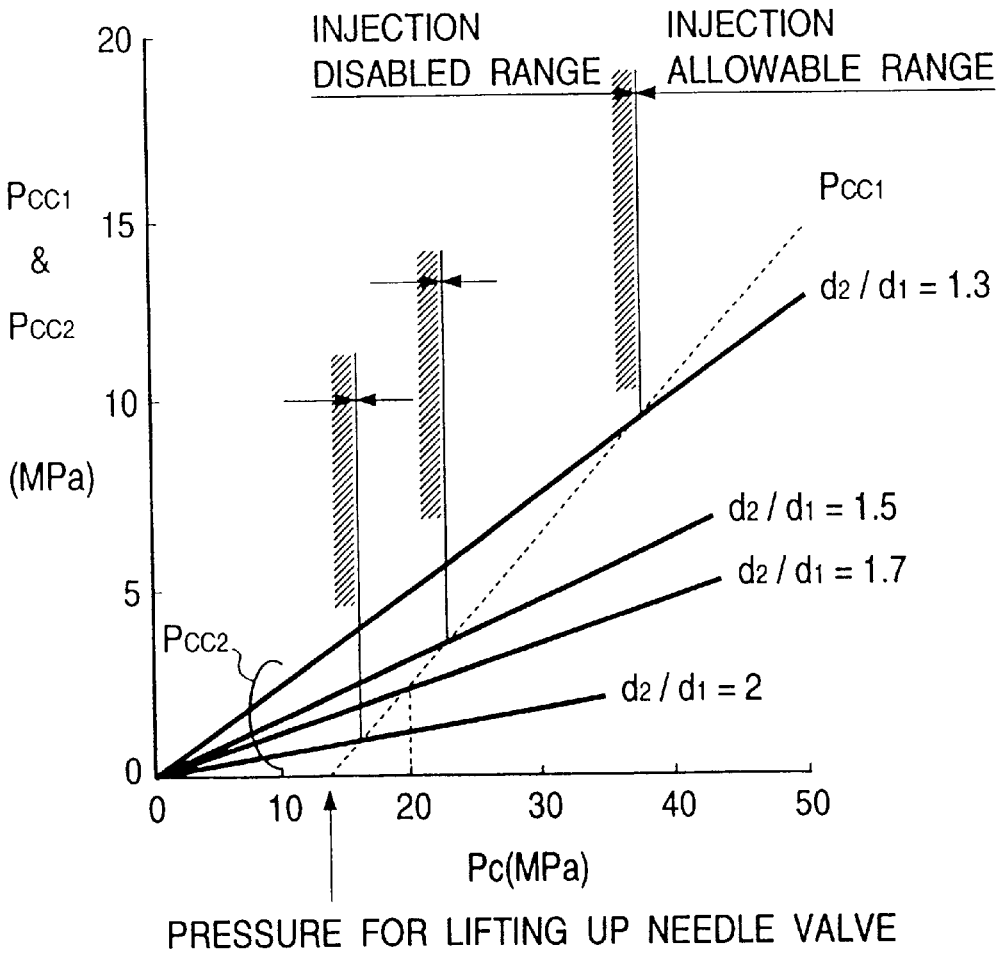
FIG. 7 is a graph which shows the relation among supplied fuel pressure $P_C$ and pressure $P_{CC1}$ and minimum pressure $P_{CC2}$ within a pressure control chamber.

FIG. 7 shows the relation among the supplied fuel pressure $P_C$, the pressure $P_{CC1}$ within the pressure control chamber 30, and the minimum pressure $P_{CC2}$. A broken line indicates the above equation (1), and solid lines indicate the equation (4) when $d_2/d_1$ is changed.

Within a range of $P_{CC1}>P_{CC2}$, the fuel injector 90 is enabled to spray the fuel. Specifically, when the supplied fuel pressure $P_C$ exceeds intersections of the broken line and the solid lines as shown in FIG. 7, it becomes possible to spray the fuel. As can be seen from the drawing, as $d_2/d_1$ is increased, a minimum value of the supplied fuel pressure $P_C$ required for spraying the fuel is decreased.

Substituting the equations (1) and (4) for the relation of $P_{CC1}>P_{CC2}$, the equation (5) below is derived.

$$(d_{NG}^2-d_{NS}^2)\times(P_C-P_O)/d_P^2>P_C/\{(1+(d_2/d_1)^4\} \quad (5)$$

Rearranging the above equation (5), and substituting a minimum injection pressure $P_{IL}$ required for assuring given engine performance for the supplied fuel pressure $P_C$, the following equation (6) is derived.

$$d_2/d_1>[d_P^2\times P_{IL}/\{(d_{NG}^2-d_{NS}^2)\times(P_{IL}-P_O)\}-1]^{1/4} \quad (6)$$

Rewriting the equation (6) using $A_N$ and $A_Q$ as employed in the equation (1.1), we obtain $$d_2/d_1>[A_Q\times P_{IL}/\{A_{N\times(PIL}-P_O)\}-1]^{1/4} \quad (6.1)$$

It will thus be appreciated that even if the diameter $d_P$ of the control piston 12, the guide diameter $d_{NG}$ of the needle valve 220, the seat diameter $d_{NS}$ of the needle valve 220, and the valve-opening pressure $P_O$, and the minimum injection pressure $P_{IL}$ are changed, the fuel injection from the fuel injector 90 is accomplished by selecting a value of $d_2/d_1$ so as to meet the equation (6).

When the coil 24 is turned off, the valve 21 is seated on the valve seat 203*a* by the spring force of the spring 27, thereby blocking the fluid communication between the pressure balancing chamber 40 and the fuel return passage 104. This causes the pressure $P_{CC}$ within the pressure control chamber 30 to rise to move the needle valve 220 into engagement with the spray hole 101*a* of the spray nozzle 2 so that the fuel injection is stopped.

Figure 8:
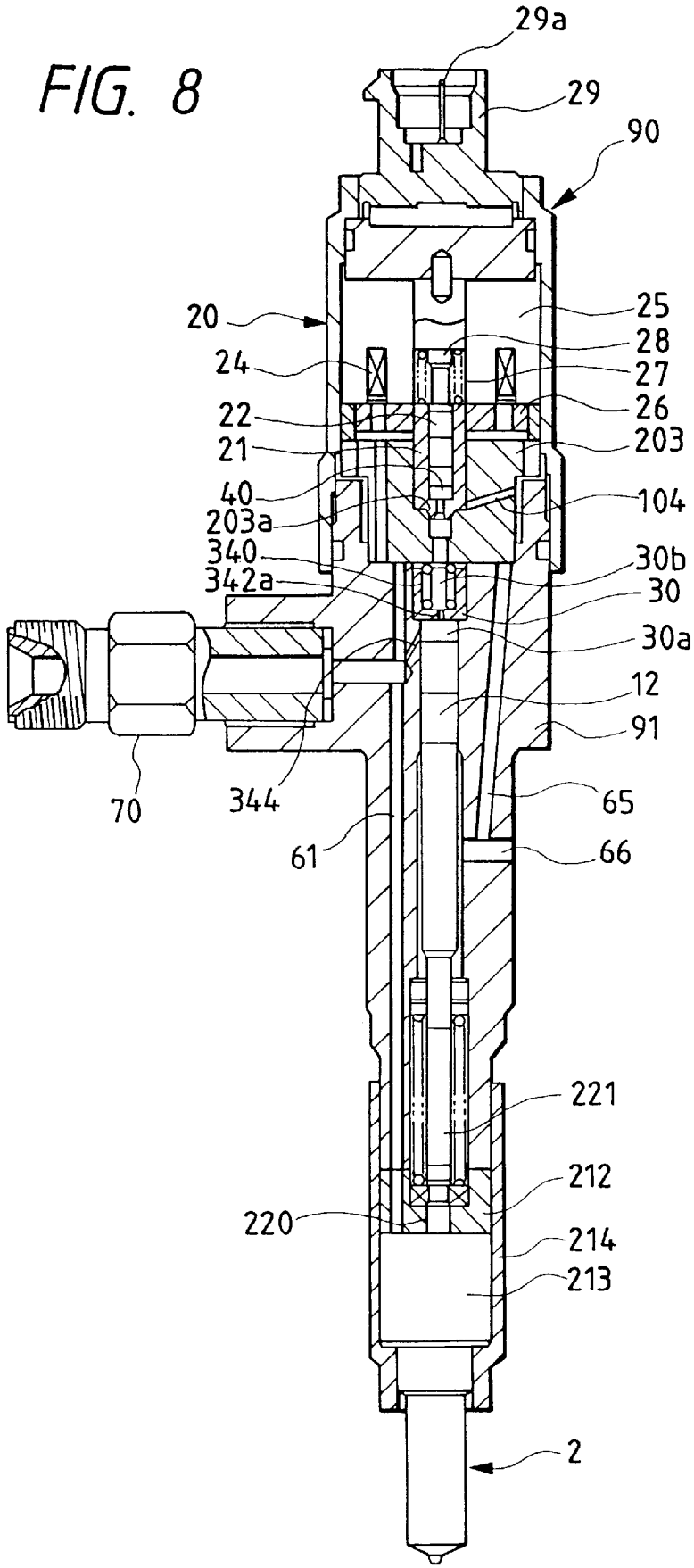
FIG. 8 is a cross-sectional view which shows a fuel injector of the third embodiment of the invention.
Figure 9:
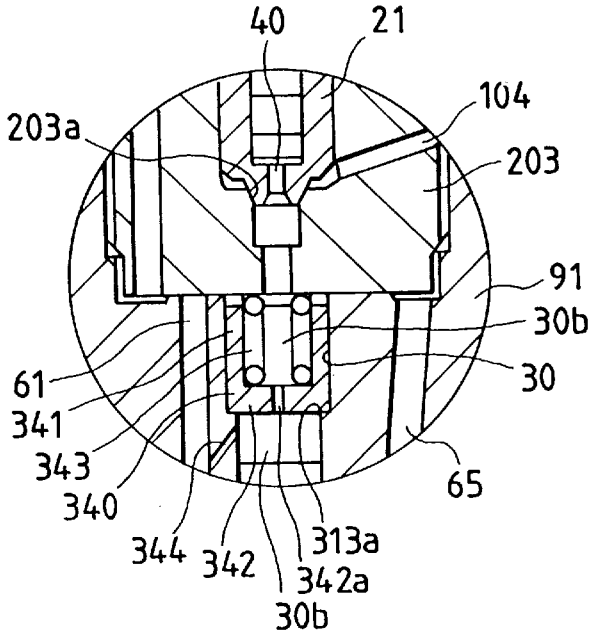
FIG. 9 is a partially enlarged sectional view of FIG. 8.

FIGS. 8 and 9 show the third embodiment of the fuel injector of the invention which is different from the second embodiment shown in FIGS. 3 and 4 only in the structure as shown in FIG. 9. Other arrangements are identical, and explanation thereof in detail will be omitted here.

The flow restricting piston 340 is, as shown in FIG. 9, disposed within the pressure control chamber 30 and urged by the spring 343 into constant engagement with the shoulder portion (i.e., a seat) 313*a* formed in an inner wall of the injector body 91. The flow restricting piston 340 includes the hollow cylinder 341 and the bottom 342 integrally formed with the cylinder 341. The cylinder 341 is moved with turning on and off of the solenoid valve 20 vertically, as viewed in the drawing, in liquid-tight engagement of an outer wall thereof with the inner wall of the injector body 91.

The flow restricting piston 340 divides at the bottom 342 the pressure control chamber 30 into the first pressure control chamber 30*a* and the second pressure control chamber 30*b* which communicate with each other through the flow restricting passage or orifice 342*a* formed in the bottom 342. The orifice 342*a* restricts the flow rate of fuel entering the second pressure control chamber 30*b* from the first pressure control chamber 30*a*. The first pressure control chamber 30*a* communicates with the fuel supply passage 61 through the inlet orifice 344. The second pressure control chamber 30*b* communicates with the pressure balancing chamber 40 formed in the outer valve 201. A flow area of the orifice 342*a* is greater than that of the inlet orifice 344.

Figures 10A, 10B, 10C, 10D:
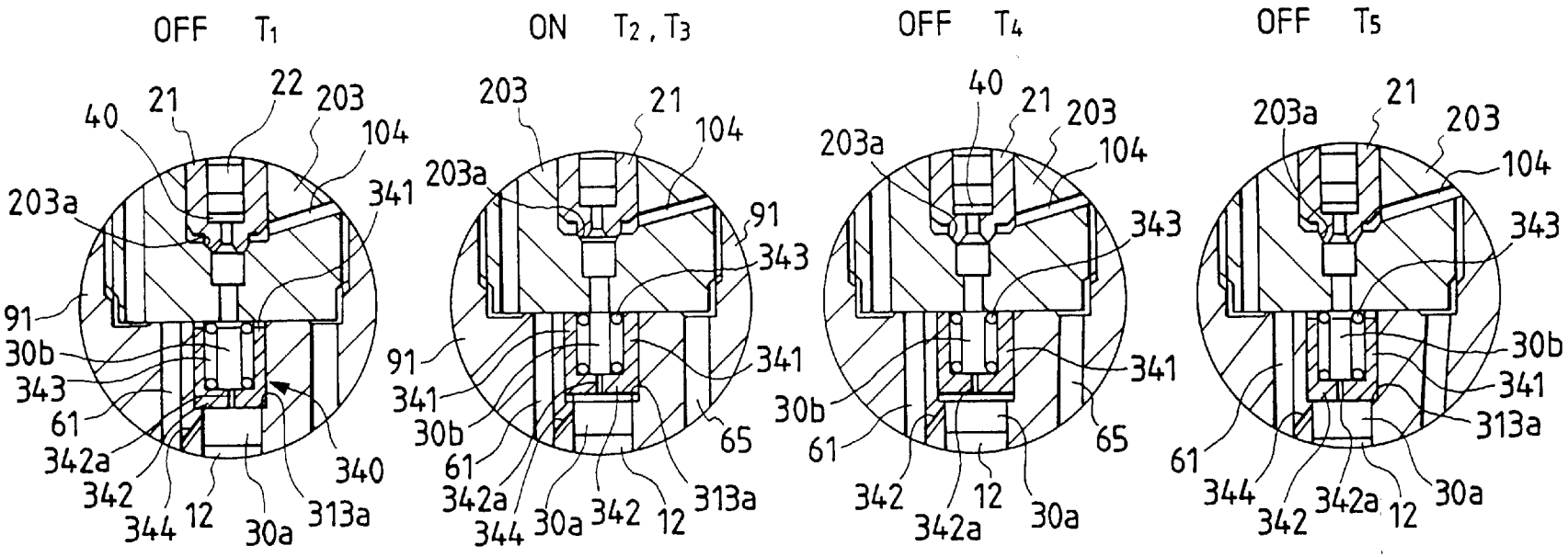
FIGS. 10(*a*) to 10(*d*) are partially cross-sectional views which show sequential operations of a solenoid valve disposed within the fuel injector of FIG. 8.

The operation of the fuel injector 90 when the supplied fuel pressure Pc is at a lower level (i.e., $P_{CC1}<P_{CC2}$ as discussed later) will be discussed below with reference to FIGS. 10(*a*) to 10(*d*) and When the coil 24 of the solenoid valve 20 is in the off position, the valve 21 is, as shown in FIG. 10(*a*), seated on the valve seat 203*a*, blocking the fluid communication of the pressure control chamber 30 and the pressure balancing chamber 40 with the fuel return passage 104 so that the fuel pressures within the first and second pressure control chambers 30*a* and 30*b* and the pressure balancing chamber 40 are maintained at high levels. The pressures or forces urging the valve 21 in the valve-opening and -closing directions are, as described above, substantially equal to each other.

When the coil 24 is turned on, it will cause the valve 21 leaves the valve seat 203*a* to establish the fluid communication between the second pressure control chamber 30*b* and the fuel return passage 104 and between the first pressure control chamber 30*a* and the fuel return passage 104 through the orifice 342*a* and the second pressure control chamber 30*b*. Since the flow rate of fuel entering the second pressure control chamber 30*b* from the first pressure control chamber 30*a* is restricted by the orifice 342*a*, and the flow area of the orifice 342*a* is, as described above, greater than that of the inlet orifice 344, the fuel pressures within the first and second pressure control chambers 30*a* and 30*b* are decreased so that the fuel pressure within the second pressure chamber 30*b* is lower than that of the first pressure control chamber 30*a*. This produces a pressure difference between the first and second pressure control chambers 30*a* and 30*b* which is greater than the spring force of the spring 343, thereby causing the flow restricting piston 340 to leave the shoulder portion 313*a* so that an upper end of the cylinder 341 is brought into engagement with the bottom of the valve body 203, thus increasing the volume of the first pressure control chamber 30*a*.

The pressure $P_{CC1}$ within the first pressure chamber 30*a* may be derived by the equation (1) as described above.

When the valve 21 leaves the valve seat 203*a*, and the cylinder 341 engages the valve body 203, the flow rate of fuel entering the first pressure control chamber 30*a* is balanced with that flowing out of the second pressure control chamber 30*b*. If the diameter of the inlet orifice 344 is defined as $d_1$, the flow rate of fuel passing through the inlet orifice 344 is defined as $Q_1$, the flow coefficient of the inlet orifice 344 is defined as $C_1$, the diameter of the outlet orifice 342*a* is defined as $d_2$, the flow rate of fuel passing through the outlet orifice 342*a* is defined as $Q_2$, and the flow coefficient of the outlet orifice 342*a* is defined as $C_2$, in a steady state wherein the pressure $P_{CC}$ within the first pressure control chamber 30*a* reaches the constant minimum pressure $P_{CC2}$ as represented by the equation (3), then $Q_1$ will be equal to $Q_2$.

Figure 12:
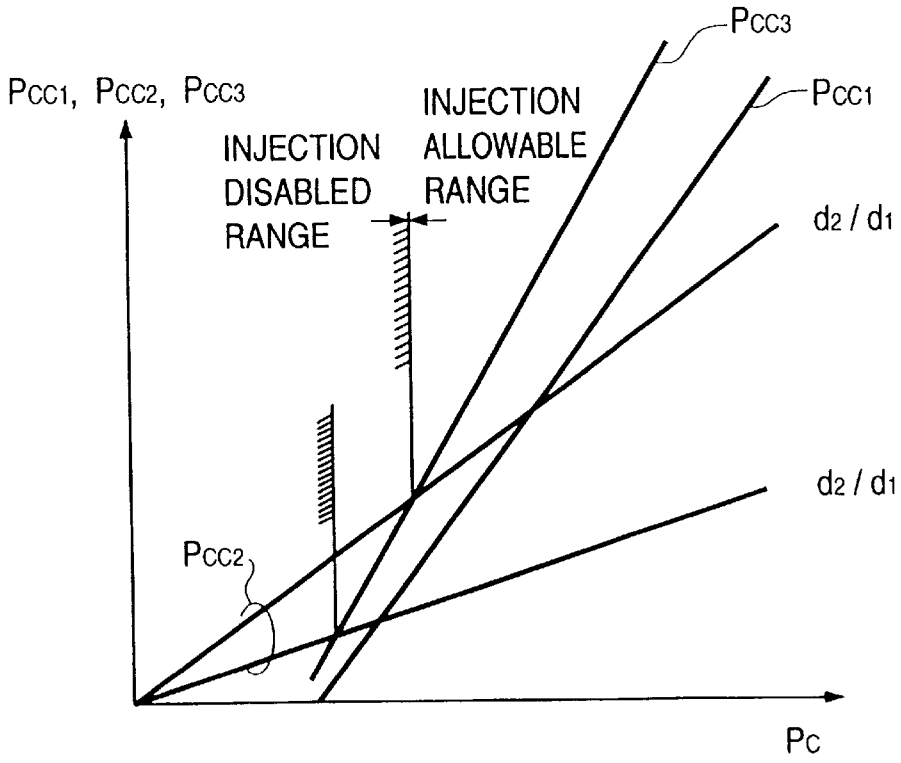
FIG. 12 is a graph which shows the relation among supplied fuel pressure $P_C$, pressure $P_{CC1}$ and minimum pressure $P_{CC2}$ within a first pressure control chamber, and fuel pressure $P_{CC3}$ within the first pressure chamber required for closing a spray nozzle.
Figure 11:
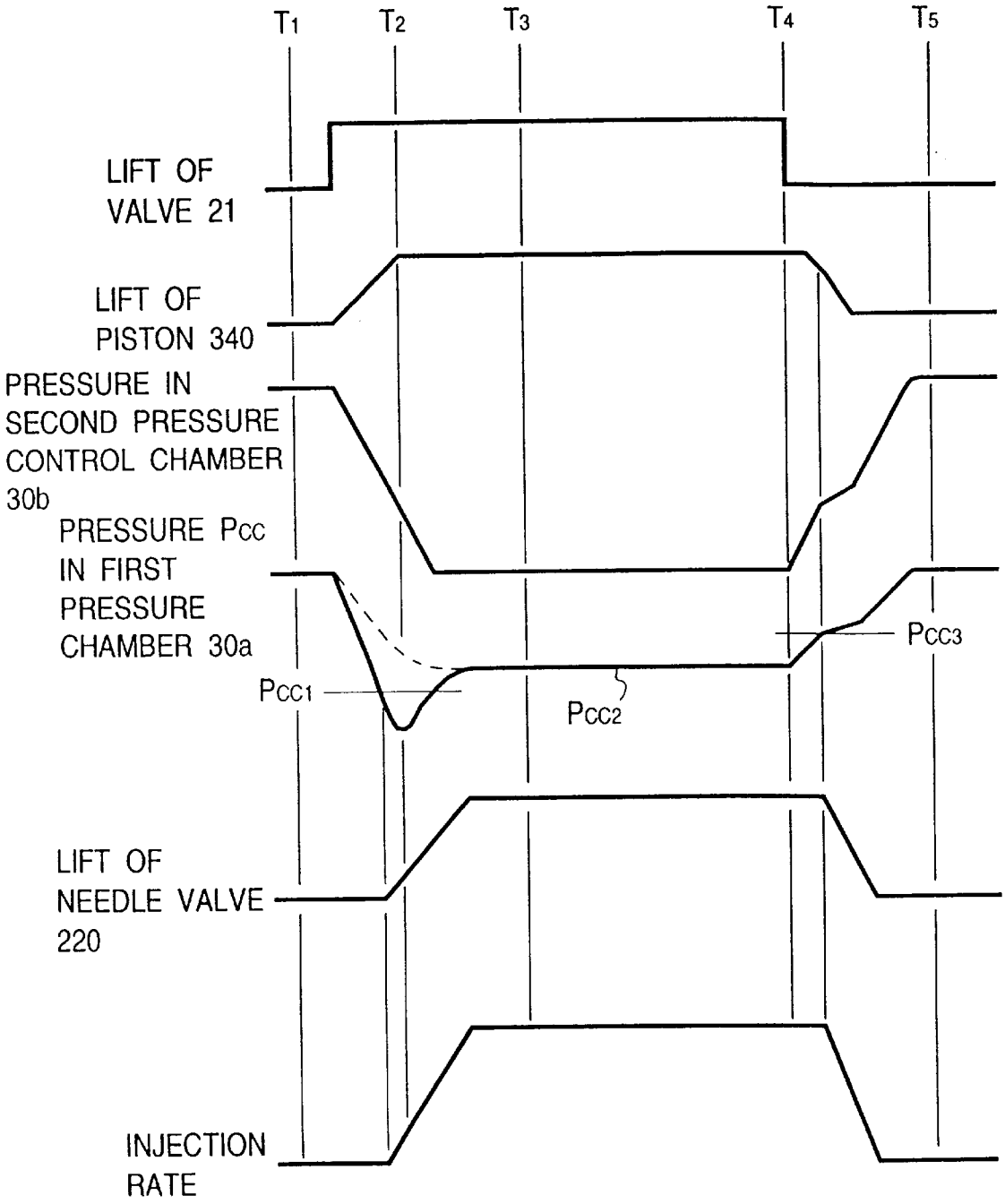
FIG. 11 is a time chart which shows operations of the valve 201, the flow restricting piston 340, and the needle valve 220, changes in pressure of the first and second pressure control chambers 30*a* and 30*b*, and a fuel injection rate.

When the supplied fuel pressure $P_C$ drops during rest of the flow restricting piston 340 to fall within a range of $P_{CC1}<P_{CC2}$ as shown in FIG. 12, it will cause the fuel injector 90 to be deactivated so that the fuel is not sprayed. However, when the solenoid valve 20 is turned on to lift up the flow restricting piston 340 so that the volume of the first pressure control chamber 30*a* is increased, the pressure $P_{CC}$ within the first pressure control chamber 30*a* drops, as shown in FIG. 11, below the pressure $P_{CC1}$ which is smaller than the minimum pressure $P_{CC2}$. This pressure drop causes the needle valve 220 to be lifted up along with the pressure control piston 12 so that the fuel is sprayed from the spray nozzle 2.

When the needle valve 220 is lifted up, a pressure-energized area of the needle valve 220 on which the fuel pressure supplied from the fuel supply passage 61 acts in the valve-opening direction is increased so that the fuel pressure $P_{CC3}$ within the first pressure chamber 30*a* required for moving the needle valve 220 downward to close the spray nozzle 2 will be higher than the minimum pressure $P_{CC2}$ as well as the pressure $P_{CC1}$. The fuel pressure $P_{CC3}$ may be expressed by the following equation.

$$P_{CC3}=\{d_{NG}^2\times P_C-(d_{NG}^2-d_{NS}^2)\times P_O\}/d_P^2 \quad (7)$$

Therefore, even after the increase in volume of the first pressure control chamber 30*a* is stopped, and then the fuel pressure within the first pressure control chamber 30*a* is elevated to reach the minimum pressure $P_{CC2}$, the fuel injector 90 is allowed to spray the fuel.

When the coil 24 is turned off, the valve 21 is, as shown in FIG. 10(*c*), seated on the valve seat 203*a* by the spring force of the spring 27 to block the fluid communication of the second pressure chamber 30*b* and the pressure balancing chamber 40 with the fuel return passage 104. The fuel flowing through the inlet and outlet orifices 344 and 342*a* increases, as can be seen in FIG. 11, the fuel pressures within the first and second pressure control chambers 30*a* and 30*b*. However, immediately after the coil 24 is turned off, the pressure difference between the first and second pressure control chambers 30*a* and 30*b* prevents the flow restricting piston 340 from dropping so that the flow restricting piston 340 is in engagement with the bottom of the valve body 203. The needle valve 220 is not moved downward until the fuel pressure $P_{CC}$ within the first pressure control chamber 30*a* exceeds the fuel pressure $P_{CC3}$.

When the coil 24 continues to be turned off, the pressure difference between the first and second pressure control chambers 30*a* and 30*b* is decreased so that the flow restricting piston 340 starts to move downward by the spring force of the spring 343. When the fuel pressure $P_{CC}$ within the first pressure control chamber 30*a* continues to be elevated and exceeds the fuel pressure $P_{CC3}$, it will cause the needle valve 220 to be moved downward in the valve-closing direction along with the control piston 12. This increases the volume of the first pressure control chamber 30*a* so that the fuel pressure therewithin is decreased, thereby causing the flow restricting piston 340 to be moved downward quickly to increase the volume of the second pressure control chamber 30*b*. Specifically, the rates of elevation in pressure within the first and second pressure control chambers 30*a* and 30*b* drop, as shown in FIG. 11, for a short time, however, upon engagement of the bottom 342 of the flow restricting piston 340 with the shoulder portion 313*a* as shown in FIG. 10(*d*), the rates of elevation in pressure within the first and second pressure control chambers 30*a* and 30*b* are increased again. The needle valve 220 then closes the spray nozzle 2 to stop the fuel injection.

As apparent from the above discussion, the fuel injector 90 of the third embodiment is operable to spray the fuel as long as the supplied fuel pressure $P_C$ drops to fall in the range of $P_{CC1}<P_{CC2}$, but the condition of $P_{CC3}>P_{CC2}$ is met.

Figure 13:
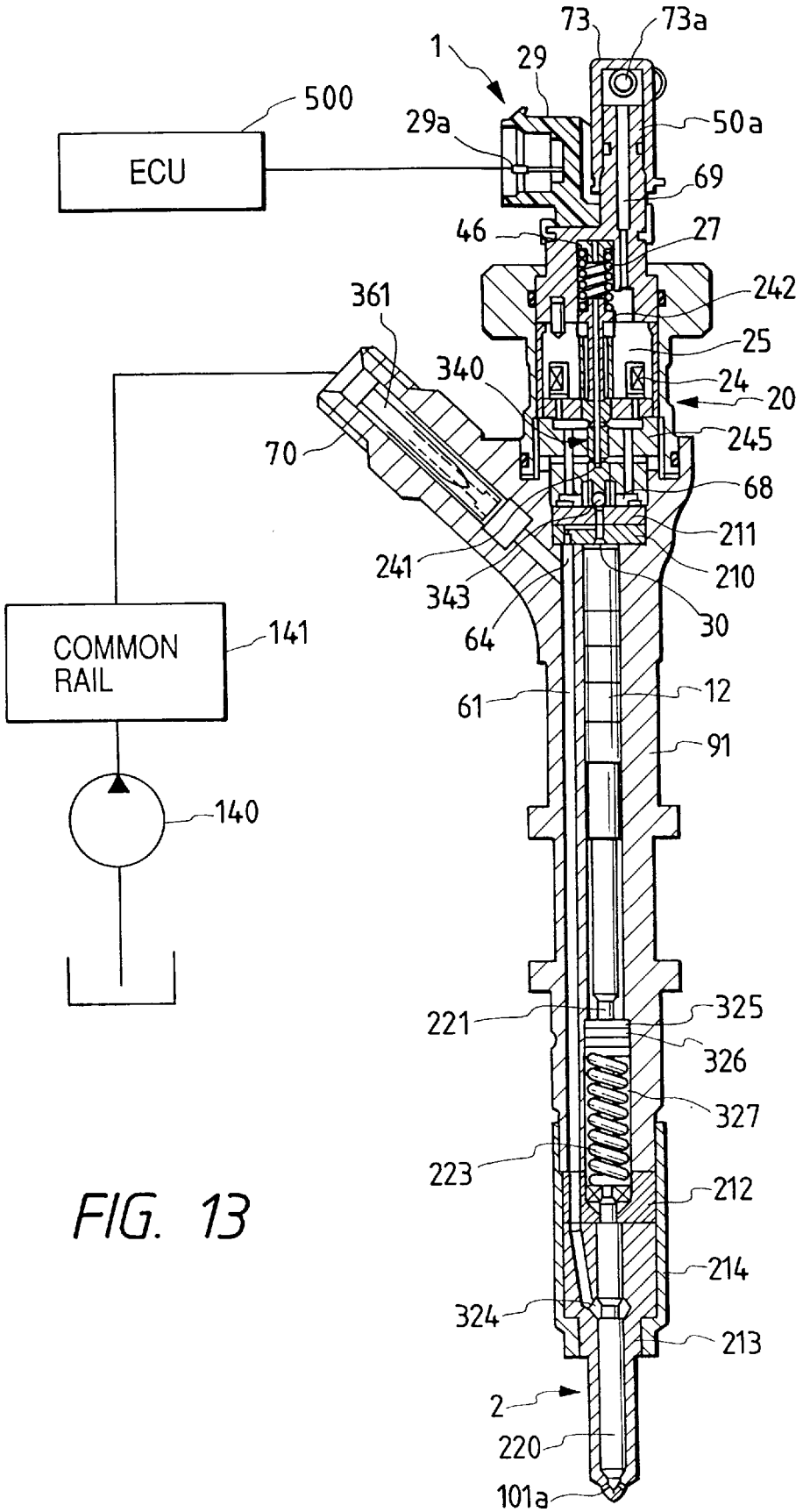
FIG. 13 is a cross sectional view taken along the line I—I in FIG. 16 which shows a fuel injector incorporated in a fuel injection apparatus for an internal combustion engine according to the fourth embodiment of the invention.

FIG. 13 shows a fuel injection apparatus for a diesel engine equipped with a solenoid-operated fuel injector 1 according to the fourth embodiment of the invention.

The fuel injector 1 is connected at an inlet port 70 to a common rail 141 through a fuel supply pipe. To the common rail 141, high-pressure fuel is supplied through a fuel pump 140. A control signal is inputted to a pin 29*a* of a wire harness connector 29 from an electronic control unit (ECU) 500 for controlling the fuel injection into a combustion chamber of the engine.

The fuel injector 1 includes a spray nozzle 2 and an injector body 91. The spray nozzle 2 includes a nozzle body 213 having a spray hole 101*a* formed in the tip thereof. A needle valve 220 is slidably disposed within the nozzle body 213 to close and open the spray hole 101*a*. The nozzle body 213 and the injector body 91 are jointed through a packing chip 212 by a retaining nut 214. A pressure pin 221 and a control piston 12 are disposed within the injector body 91 in alignment with the needle valve 220. The control piston 12 is in contact with the pressure pin 221, but may alternatively be bonded thereto. The pressure pin 221 is disposed within a spring 223. The spring 223 urges the pressure pin 221 downward, as viewed in the drawing, to bring the needle valve 220 into constant engagement with the spray hole 101*a*. The set load of the spring 223 is adjusted by load adjusting spacers 325 and 326. The control piston 22 is exposed at an end opposite to the spray hole 101*a* to a pressure control chamber 30.

The high-pressure fuel entering the inlet port 70 passes through a fuel filter 361 and flows both to high-pressure fuel passages 61 and 64. The part of the high-pressure fuel entering the high-pressure passage 61 is supplied directly to an annular fuel sump 324 formed around the periphery of the needle valve 220, while the other entering the high-pressure fuel passage 64 is supplied to the pressure control chamber 30. The pressure of fuel in the fuel sump 324 acts on the needle valve 220 to lift it upward, as viewed in the drawing, for establishing fluid communication between the fuel sump 324 and the spray hole 101*a*, while the pressure of fuel in the pressure control chamber 30 acts on the control piston 12 to urge the needle valve 220 downward so that it closes the spray hole 101*a*.

Figure 14:
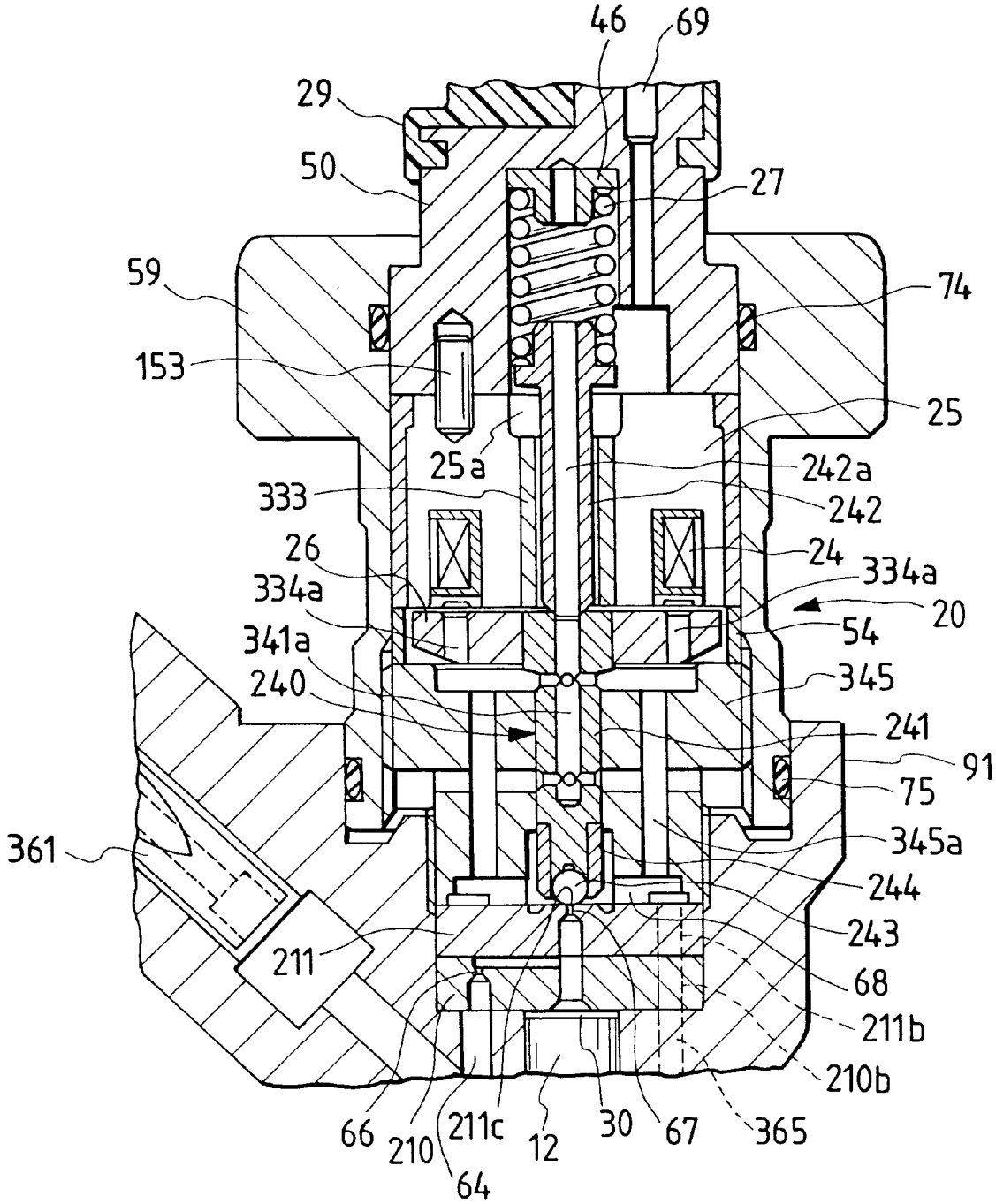
FIG. 14 is a partial cross sectional view which shows a major portion of the fuel injection in FIG. 1.
Figure 15:
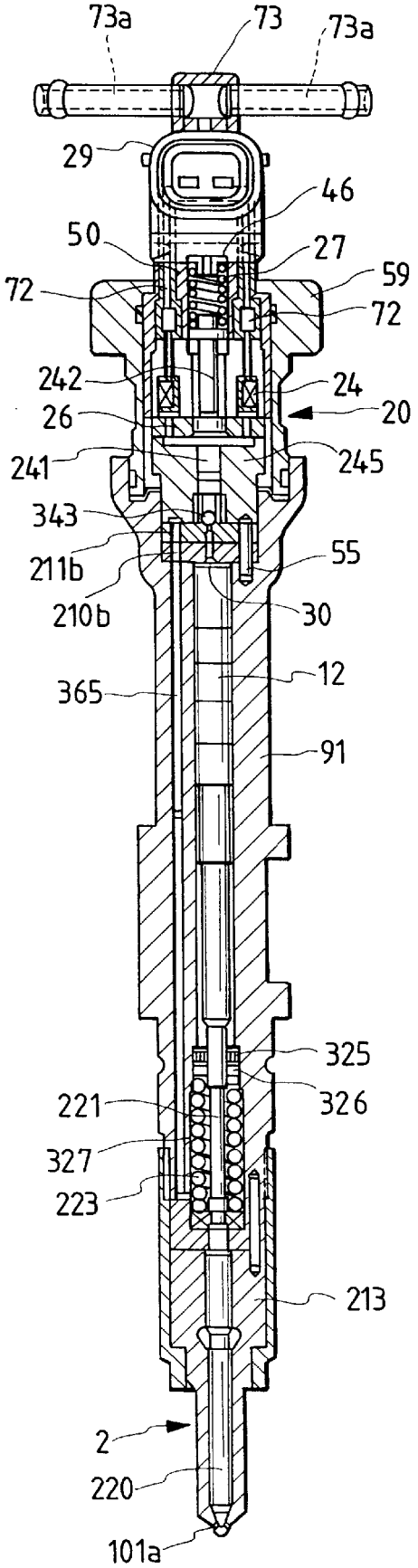
FIG. 15 is a cross sectional view taken along the line III—III in FIG. 16.
Figure 16:
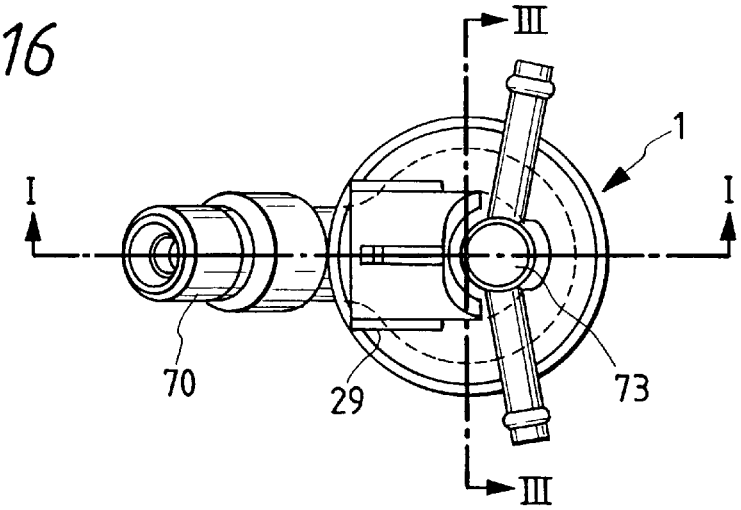
FIG. 16 is a plan view which shows a fuel injector according to the first embodiment of the invention.

The injector body 13 has also formed therein a fuel drain passage 365, as clearly shown in FIG. 15, which communicates with a spring chamber 327 and drains the fuel leaking out of sliding clearances between inner walls of the injector body 91 and the spray nozzle 2 and outer peripheral surfaces of the control piston 12 and the needle valve 220 to a low-pressure fuel chamber 68 through fuel passages 210*b* and 211*b*, as clearly shown in FIG. 14, formed in first and second orifice plates 210 and 211, as will be described later in detail. The fuel within the low-pressure fuel chamber 68 passes through low-pressure fuel passages 345*a* formed in a valve cylinder 345, a low-pressure fuel passage 341*a* formed in a valve shaft 241, a low-pressure fuel passage 242*a* formed in a plunger 242, holes 334*a* formed in an armature 26 of a solenoid valve 20, a low-pressure fuel passage 25*a* extending along the center of a core of the solenoid valve 20, and a low-pressure fuel passage 69 formed in a housing 50 and then flows out of a fuel withdrawal union 73 through a low-pressure fuel passage 73*a*, as shown in FIG. 13 so that excess fuel is drained outside the fuel injector 1.

Figure 17A:
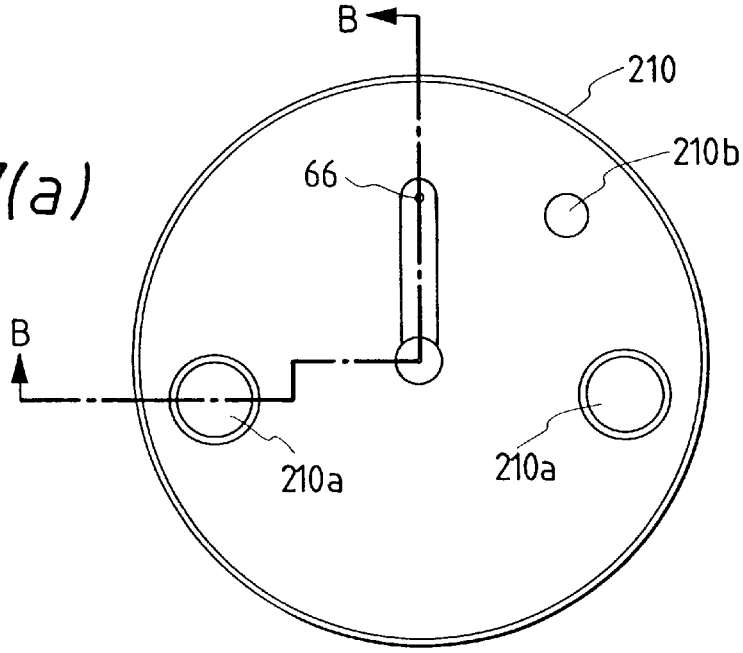
FIG. 17(*a*) is a plan view which shows a first orifice plate mounted in the fuel injector in FIG. 13.
Figure 17B:
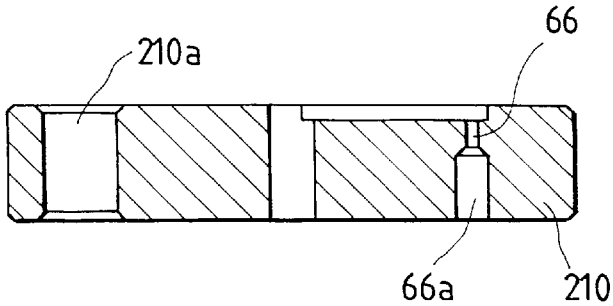

The first and second orifice plates 210 and 211 are, as clearly shown in FIG. 14, disposed adjacent each other so that thicknesswise directions thereof coincide with each other and retained by the valve cylinder 345 within the injector body 91. The first orifice plate 210 has formed therein a first orifice 66 which restricts the flow rate of fuel from the high-pressure fuel passage 64 to the pressure control chamber 30. The second orifice plate 211 has a second orifice 67 formed in the center thereof which limits the flow rate of fuel from the pressure control chamber 30 to the low-pressure fuel chamber 68. The first and second orifice plates 210 and 211 are, as shown in FIGS. 17(*a*) to 18(*b*), made of discs. The first and second orifices 66 and 67 communicate with large-diameter holes 66*a* and 67*a* formed in bottoms of the first and second orifice plates 210 and 211 coaxially with the first and second orifices 66 and 67 and extend parallel to vertical center lines (i.e., the thicknesswise directions) of the first and second orifice plates 210 and 211, respectively, so that they are easy to machine with high accuracy.

The first orifice plate 210 has formed therein two bores 210*a*. Similarly, the second orifice plate 211 has formed therein two bores 211*a*. The bores 210a are arranged at the same interval away from the center of the first orifice plate 210 so that a line extending through the centers of the bores 210*a* is offset from the center of the first orifice plate 210. Similarly, the bores 21 la are arranged at the same interval away from the vertical center line of the second orifice plate 211 so that a line extending through the centers of the bores 211*a* is offset from the center of the second orifice plate 211. Two positioning knock pins 55 (only one is shown in FIG. 15 for the brevity of illustration) are inserted into the injector body 91 through the bores 210*a* and 211*a* of the first and second orifice plates 210 and 211 which are aligned with each other. This fixes the positional relation between the first and second orifice plates 210 and 211 and the injector body 91 and also brings the fuel passages 210*b* and 211*b* formed in the first and second orifice plates 210 and 211 into coincidence with each other. The valve cylinder 345 and the injector body 91 are connected in screw fashion.

Figure 18A:
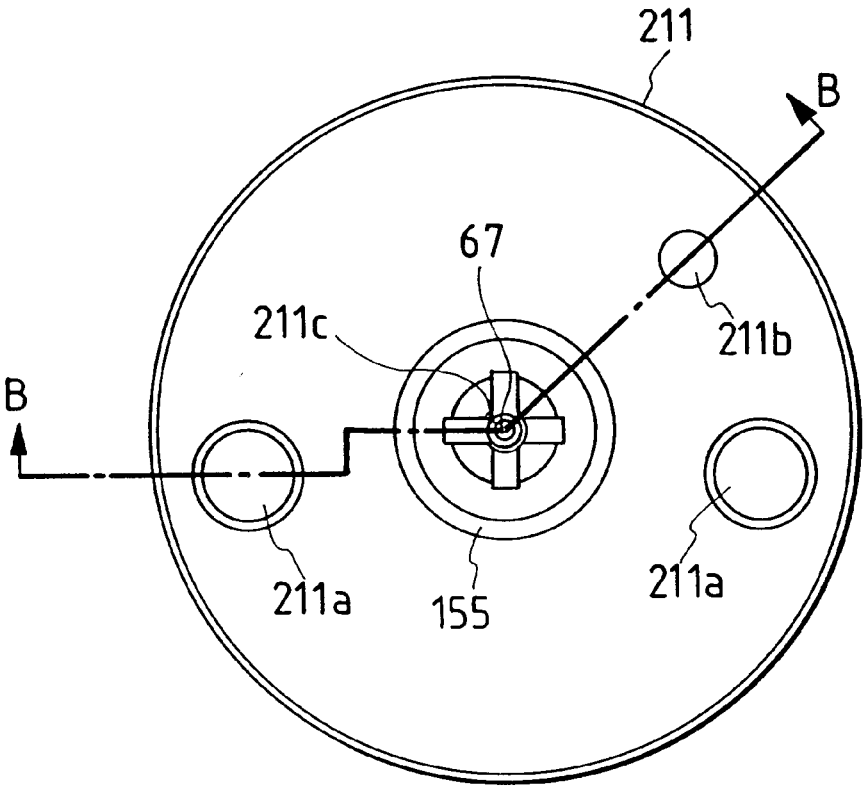
FIG. 18(*a*) is a plan view which shows a second orifice plate mounted in the fuel injector in FIG. 13.
Figure 18B:
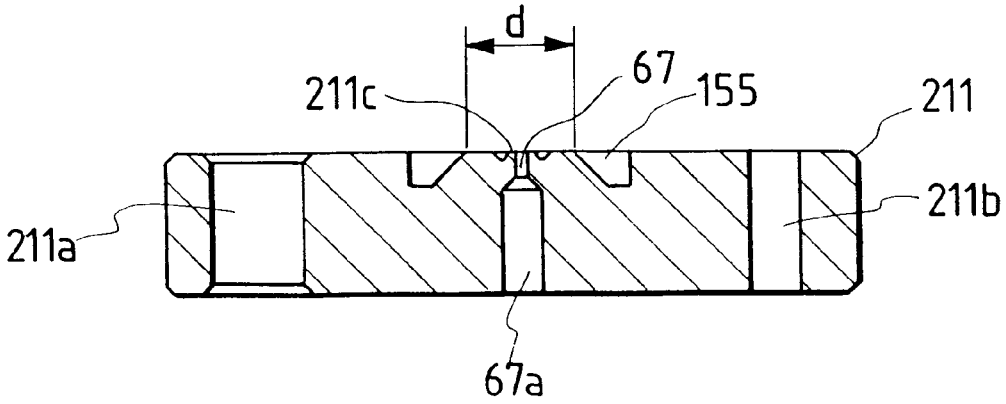

The second orifice plate 211 has, as shown in FIGS. 14 and 18(*b*), an annular flat surface 211*c* formed on an upper surface around the center thereof (i.e., the second orifice 67). The annular flat surface 211*c* works as a valve seat on which a ball 243 (i.e., a valve head), as will be described later in detail, of the solenoid valve 20 is seated. When the ball 243 is seated on the annular flat surface 211*c*, it blocks the fluid communication between the pressure control chamber 30 and the low-pressure fuel chamber 68. An annular path 155 is formed around the annular flat surface 211*c* which adds a given volume to the low-pressure fuel chamber 68 for facilitating ease of the fuel flow to the low-pressure fuel chamber 68 when the ball 243 is lifted away from the second orifice plate 211.

The first and second orifices 66 and 67 may be formed by drilling the first and second orifice plates 210 and 211 and reaming the drilled holes or by drilling the first and second orifice plates 210 and 211 in the electrical discharge machining. The first and second orifices thus formed may also be polished in a finishing process by forcing an abrasive solution made of a mixture of liquid and abrasive grain therethrough until the flow of the abrasive solution through the first and second orifices 66 and 67 reaches a given flow rate.

The solenoid valve 20 is a two-way valve designed to selectively establish and block the fluid communication between the pressure control chamber 30 and the low-pressure fuel chamber 68. The solenoid valve 20 is, as shown in FIGS. 13 and 14, installed in the injector body 91 by the retaining nut 59. A pin 153 is inserted into the housing 50 and the core 25 to fix an angular relation therebetween and also hold relative rotation of the core 25 and the housing 50 when the retaining nut 59 is fastened during assembly for preventing a rotational load from acting on feeder terminals 72 shown in FIG. 15.

The solenoid valve 20 includes, as shown in FIG. 14, a coil 24 and a movable member 240. The coil 24 is made of wire wound within an annular groove formed in the core 25 and supplied with the power through the pin or terminal 29*a* of the connector 29. The core 25 is formed with 0.2 mm-thick silicon steel plates laminated spirally and welded to a hollow cylinder 333 in which the plunger 242 is disposed. The movable member 240 includes the valve shaft 241, the plunger 242, the ball 243, and the support 244. The valve shaft 241 and the plunger 242 are urged into constant engagement with each other by the fuel pressure and spring pressure exerted from the pressure control chamber 30 and the spring 27, respectively, so that they are moved vertically together when the solenoid valve 20 is turned on and off. The plunger 242 is made of a non-magnetic stainless steel for eliminating a magnetic effect on a magnetic circuit. The valve shaft 241 is slidably supported within the valve cylinder 345 and is made from a wear resistant material such as a magnetic material because the valve shaft 241 is magnetically located out of the magnetic circuit. The armature 26 is mounted on an upper portion of the valve shaft 241 in a press fit at a given interval away from a lower end of the core 25 of the solenoid valve 20 and made from, for example, a silicon steel since it needs to work as part of the magnetic circuit rather than needing to have wear resistance and has formed therein a plurality of bores 334*a* for reducing the fluid resistance during movement. The armature 26 may alternatively be mounted on the valve shaft 241 in caulking, welding, or any other suitable manner.

The amount of lift of the movable member 240 may be adjusted by changing the thickness of a spacer 54. The movable member 240 is lifted upward until the valve shaft 241 reaches the lower end of the cylinder 333. The armature 26, when lifted up to the upper limit, faces the lower end of the core 25 through a given gap so that the movable member 240 can be moved downward, as viewed in FIG. 14, quickly when the coil 24 is turned off.

The support 244 is made of a hollow cylindrical member and mounted on an end of the valve shaft 241 in a press fit or welding. The ball 243 is disposed rotatably within a chamber defined by an inner wall of the support 244 and a cone-shaped recess formed in the end of the valve shaft 241 with a clearance of several $\mu$m between itself and the inner wall of the support 244. The support 244 is caulked at an end thereof to retain the ball 243 therein. The ball 243 is made from ceramic or cemented carbide and has formed thereon a flat surface which is seated on the annular flat surface 211*c*, as shown in FIG. 18(*b*), of the second orifice plate 211 for closing the second orifice 67 to block the fluid communication between the pressure control chamber 30 and the low-pressure fuel chamber 68. The amount of lift of the valve shaft 241 is approximately 100 $\mu$m, which allows the ball 243 to face at the flat surface to the second orifice plate 211 at all times regardless of the vertical position of the valve shaft 241 and to be seated on the annular flat surface 211*c* to close the second orifice 67 completely even when the ball 243 and the second orifice 67 are somewhat shifted in relative angular position.

The plunger 242 is disposed slidably within the cylinder 33 with a clearance with the inner wall thereof which is greater than the above sliding clearance. The coil spring 27 is interposed between a spacer or shim 46 and a flange of the plunger 242 to urge the plunger 242 downward so that the ball 243 closes the second orifice 67. The spring pressure acting on the plunger 242 may be adjusted by changing the thickness of the shim 46.

This embodiment has the following specifications on major parts of the structure:

1. diameter of the first orifice 66=ϕ0.20 mm
2. diameter of the second orifice 67=ϕ0.32 mm
3. diameter of the control piston 12=ϕ5.0 mm
4. stroke of the movable member 240=0.10 mm
5. diameter of the needle valve 220=ϕ4.0 mm
6. seat diameter of the needle valve 220 (i.e., the diameter of a seat area of a head of the needle valve 220 exposed to the spray hole 101*a*)=ϕ2.25 mm
7. set load of the spring 27=50 N
8. set load of the spring 223=40 N In operation, when the coil 24 of the solenoid valve 20 is deenergized, the plunger 242 is forced downward, as viewed in FIG. 14, by the spring pressure of the coil spring 27. The ball 243 is seated on the second orifice plate 211 to block the fluid communication between the pressure control chamber 30 and the low-pressure fuel chamber 68.

The diameter of the second orifice 67 (corresponding to a seat diameter of the ball 243 when seated on the second orifice plate 211) is 0.32 mm, and the diameter d, as shown in FIG. 6(*b*), of a ball seat of the second orifice plate 211 on which the ball 243 is seated is 0.50 mm. Thus, if the fuel pressure supplied from the common rail 141 (=the pressure within the pressure control chamber 30) is 150 Mpa, then the fluid pressure urging the ball 243 in a valve-opening direction is 19.5 N which is smaller than the set load of the spring 47 urging the movable member 240 of the solenoid valve 20 in a valve-closing direction that is, as described above, 50 N, so that the movable member 240 is not lifted upward as long as the coil 24 is turned off.

Since the diameter of the control piston 12 is 5.0 mm, the diameter of the needle valve 220 is 4.0 mm, the seat diameter of the needle valve 220 is, as described above, 2.25 mm, a pressure-energized area of the control piston 12 is greater than that of the needle valve 220, and a difference therebetween is approximately 11 $mm^2$. Since the spring pressure of the coil spring 223 urges the needle valve 220 in the valve-closing direction, the sum of the fuel pressure within the pressure control chamber 30 urging the control piston 12 in the valve-closing direction and the spring pressure of the spring 223 is greater than the fuel pressure within the fuel sump 324 lifting the needle valve 220 upward as long as the coil 24 is turned off. Specifically, when the solenoid valve 20 is in an offposition, the needle valve 220 continues to close the spray hole 101*a*.

When the coil 24 of the solenoid valve 20 is energized, it produces an electromagnetic force of approximately 60 N attracting the armature 26, so that the sum of the electromagnetic force and the fuel pressure within the pressure control chamber 30 urging the movable member 240 in the valve-opening direction becomes greater than the spring pressure of the coil spring 27, thereby lifting the movable member 240 upward to move the ball 243 away from the second orifice plate 211. This establishes the fluid communication between the second orifice 67 and the low-pressure fuel chamber 68 so that the fuel within the pressure control chamber 30 flows into the low-pressure fuel chamber 68 through the second orifice 67. Since the flow resistance of the second orifice 67 is smaller than that of the first orifice 66, the fuel pressure within the pressure control chamber 30 drops immediately when the ball 243 is lifted up away from the second orifice 67. When the fuel pressure within the pressure control chamber 30 drops, and the sum of the fuel pressure within the pressure control chamber 30 urging the control piston 12 in the spray hole-closing direction and the spring pressure of the coil spring 223 becomes smaller than the fuel pressure within the fuel sump 324 lifting up the needle valve 220, it will cause the needle valve 220 to be moved away from the spray hole 101*a* to initiate fuel injection.

When a given injection end is reached, the coil 24 of the solenoid valve 20 is deenergized, so that the electromagnetic force attracting the armature 26 is decreased from 60 N to zero (0). This causes the movable member 240 to be moved by the spring force of the spring 27 away from the coil 24 to bring the ball 243 into engagement with the second orifice 67. The fuel pressure within the pressure control chamber 30 is elevated by the fuel flowing from the high-pressure fuel passage 64 through the first orifice 66, so that the sum of the fuel pressure within the pressure control chamber 30 urging the control piston 12 in the spray hole-closing direction and the spring pressure of the spring 223 becomes greater than the fuel pressure within the fuel sump 324 lifting the needle valve 220 upward, thereby bringing the needle valve 220 into engagement with the spray hole 101*a* to terminate the fuel injection.

Figures 19A, 19B, 19C, 19D:
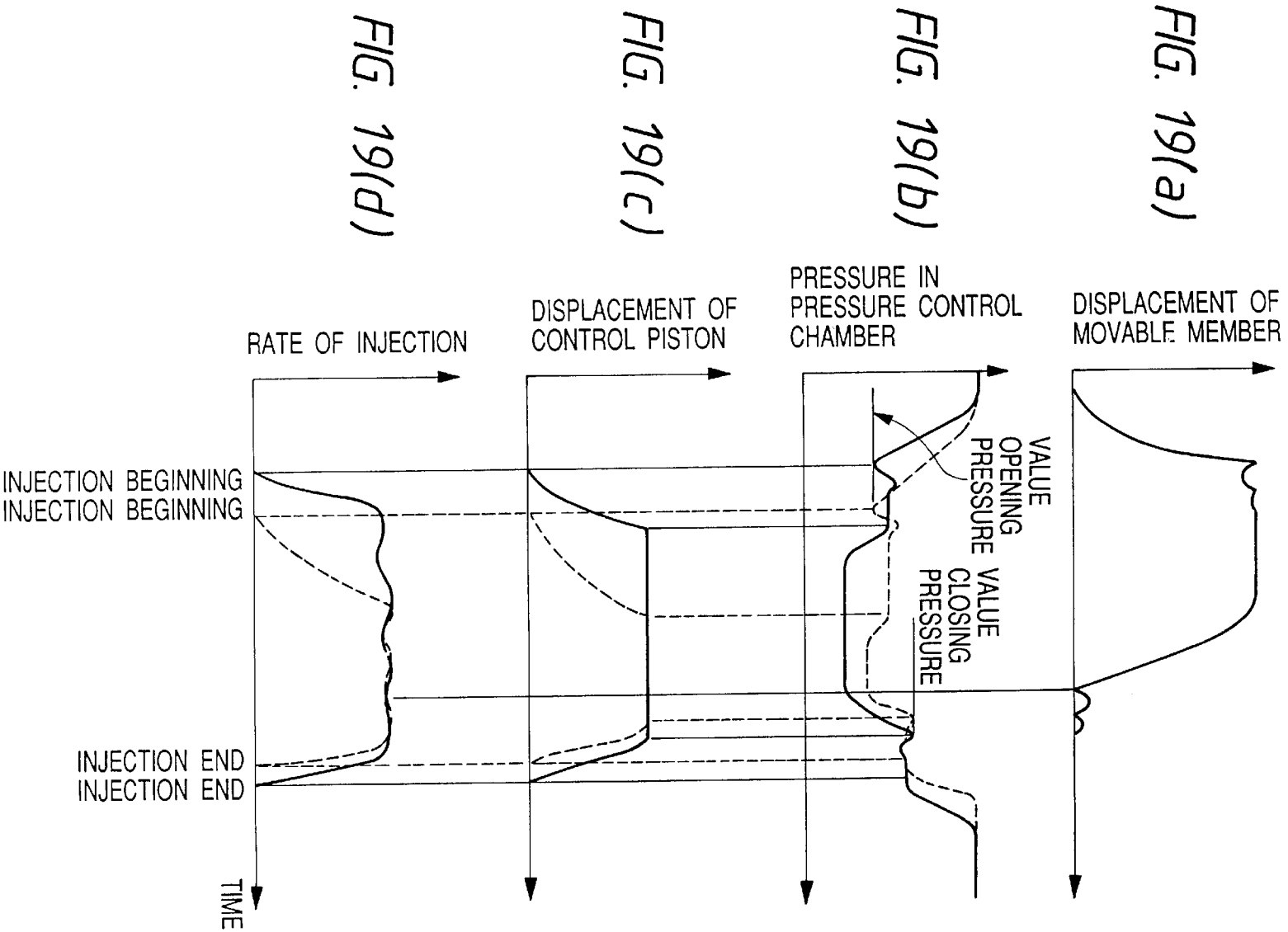
FIG. 19(*a*) is a time chart which shows a displacement of a movable member of a solenoid valve incorporated within the fuel injector in FIG. 13.

FIGS. 19(*a*) to 19(*d*) show a displacement of the movable member 240, a variation in fuel pressure within the pressure control chamber 30, a displacement of the control piston 12, a rate of injection during one cycle of injection, respectively. Solid lines indicate parameters when the first orifice 66 has a smaller diameter showing a greater flow resistance, while broken lines indicate parameters when the first orifice 66 has a greater diameter showing a smaller flow resistance.

The injection characteristics of the fuel injector 1 are almost determined by the flow rate of fuel flowing into the pressure control chamber 30 from the first orifice 66 and the flow rate of fuel flowing out of the pressure control chamber 30 into the low-pressure fuel chamber 68 through the second orifice 63. Of the injection characteristics, the start time of injection and an increase in injection rate during an early part of injection are determined by a difference in flow rate between the fuel entering the pressure control chamber 30 and the fuel emerging from the pressure control chamber 30 into the low-pressure fuel chamber 68 after the solenoid valve 20 is turned on or opened. Specifically, variations in flow rate characteristic of the first and second orifices 66 and 67 will cause a dropping speed of the pressure within the pressure control chamber 30 immediately after the solenoid valve 20 is opened to be changed. Thus, if there is a variation in flow rate characteristic of either of the first and second orifices 66 and 67, it will cause a time duration from energization of the solenoid valve 20 until the fuel pressure reaches a level at which the control piston 12 is moved in the spray hole-opening direction to be changed, thus resulting in a change in start time of injection.

As shown in FIG. 19(*b*), the dropping speed of pressure within the pressure control chamber 30 when the first orifice 66 shows a greater flow resistance, as indicated by the solid line, is higher than that when the first orifice 66 shows a smaller flow resistance, as indicated by the broken line. Additionally, the injection beginning is earlier and the increase in injection rate during the early part of injection is greater than those when the first orifice 66 shows the smaller flow resistance.

When the fuel pressure within the pressure control chamber 30 drops and reaches a valve-opening pressure initiating the upward movement of the control piston 12, the control piston 12 is moved in the spray hole-opening direction, and then the force acting on the pressure control piston 12 in the spray hole-opening direction will be balanced statically with that in the spray hole-closing direction. The fuel pressure within the pressure control chamber 30, however, continues to drop since the flow resistance of the second orifice 67 is set smaller than that of the first orifice 66, and the flow rate of fuel flowing out of the pressure control chamber 30 is greater than that of fuel entering the pressure control chamber 30. The static balance of the fuel pressures acting on the control piston 12 is, thus, lost so that the fuel pressure acting on the control piston 12 in the spray hole-opening direction becomes greater than that in the spray hole-closing direction, which will cause the pressure control piston 12 to be lifted upward until the fuel pressures in the spray hole-opening and -closing directions are balanced with each other. This step is repeated until the amount of lift of the control piston 12 reaches a given value. The pressure within the pressure control chamber 30 is almost maintained constant during a valve-opening stroke (i.e., upward movement) of the control piston 12. This constant pressure and the valve-opening pressure acting on the control piston 12 are determined by differences between pressure-energized areas of the needle valve 220 and the control piston 12 on which the fuel pressures act in the spray hole-opening and -closing directions and the spring pressure of the coil spring 223 urging the needle valve 220 in the spray hole-closing direction, and not the flow rate characteristics of the first and second orifices 66 and 67. The duration for which the fuel pressure within the pressure control chamber 30 is maintained constant is the time required for the control piston 12 to reach a fully-lifted position and may be changed by changing the flow rate characteristics of the first and second orifices 66 and 67. Specifically, as shown in FIG. 19(*b*), the duration for which the fuel pressure within the pressure control chamber 30 is kept constant when the first orifice 66 shows the smaller flow resistance indicated by the broken line is longer than that when the first orifice 66 shows the greater flow resistance indicated by the solid line.

When the control piston 12 reaches the fully-lifted position, the pressure within the pressure control chamber 30 drops below the valve-opening pressure of the needle valve 220 or down to a pressure level which is determined by the difference in flow rate characteristic between the first and second orifices 66 and 67 and is kept constant. Within this constant pressure range, the rate of injection is almost kept constant as long as the pressure acting on the top portion of the needle valve 220 is at a fixed level.

When the coil 24 is turned off to close the solenoid valve 20 after a lapse of a given period of time, the pressure within the pressure control chamber 30 rises up to a valve-closing pressure which is determined, similar to the valve-opening pressure, by the differences between pressure-energized areas of the needle valve 220 and the control piston 12 on which the fuel pressures act in the valve-opening and -closing directions and the spring pressure of the coil spring 223 urging the needle valve 220 in the valve-closing direction. When the pressure within the pressure control chamber 30 reaches the valve-closing pressure, the control piston 12 is moved in the valve-closing direction. Specifically, when the coil 24 is deenergized, the movable member 340 is moved downward, as viewed in FIG. 14, by the spring pressure of the coil spring 27. As the movable member 340 is moved in the downward direction which closes the second orifice 67, the flow rate of fuel flowing out of the second orifice 67 is decreased so that the control piston 12 is moved in the valve-closing direction before the ball 243 closes the second orifice 67 completely.

The valve-closing pressure of the control piston 12 is, similar to the valve-opening pressure, constant even if the flow rate characteristics of the first and second orifices 66 and 67 are changed. The time interval between deenergization of the solenoid valve 20 and a time when the pressure within the pressure control chamber 30 reaches the valve-closing pressure of the control piston 12 will, however, change if the pressure within the pressure control chamber 30 during the energization of the solenoid valve 20 is changed by changes in flow rate characteristic of the first and second orifices 66 and 67. Further, the time required for closing the spray hole 101*a* in the valve-closing stroke of the control piston 12 is changed, similar to the valve-opening stroke, by the difference in flow rate of fuels flowing through the first and second orifices 66 and 67. The time required for closing the spray hole 101*a* when the first orifice 66 shows the greater flow resistance, as indicated by the solid line in FIG. 19(*c*), is longer than that when showing the smaller flow resistance, as indicated by the broken line. In other words, a decrease in rate of injection at termination of fuel injection when the first orifice 66 shows the greater flow resistance is slower than that when showing the smaller flow resistance.

As will be apparent from the above discussion, an increase in flow resistance of the first orifice 66 without changing the flow rate characteristic of the second orifice 67 will cause the injection beginning to be advanced and the rate of initial injection to be increased, while it retards the injection end and prolongs the injection cut-off period. Conversely, a decrease in flow resistance of the first orifice 66 without changing the flow rate characteristics of the second orifice 67 will cause the injection beginning to be retarded and the rate of initial injection to be decreased, while it advances the injection end and shortens the injection cut-off period.

The injection characteristics other than the injection cut-off period depend upon the difference in flow rate of fuels flowing into the first orifice 66 and out of the second orifice 67. Therefore, a change in flow resistance of the second orifice 67 without changing the flow resistance of the first orifice 66 also causes the injection beginning, the rate of initial injection, and the injection end to be changed. The injection cut-off period is changed only by changing the flow resistance of the first orifice 66.

In the fourth embodiment as described above, the first and second orifice plates 210 and 211 are made of separate members, which allows the flow rate characteristics of each of the first and second orifices 66 and 67 to be adjusted in an injection characteristic adjustment process when the fuel injector 1 is assembled by replacing corresponding one of the first and second orifice plates 210 and 211. Specifically, the injection beginning, the rate of initial injection, the injection end, and the injection cut-off period may be adjusted only by replacing one of the first and second orifice plates 210 and 211.

It is necessary to determine the flow rate characteristics of spare orifice plates before replaced with the first and second orifice plates 210 and 211. In the fourth embodiment, the flow rate characteristics of each spare orifice plate is determined by passing a gas oil that is fuel for diesel engines through an orifice thereof at 10 Mpa to measure the flow rate of the gas oil. After assembly of the fuel injector 1, the flow rate characteristics of the first and second orifice plates 210 and 211 may be determined by monitoring variations in rate of injection, pressure within the pressure control chamber 30, and lift of the needle valve 220.

Figure 20:
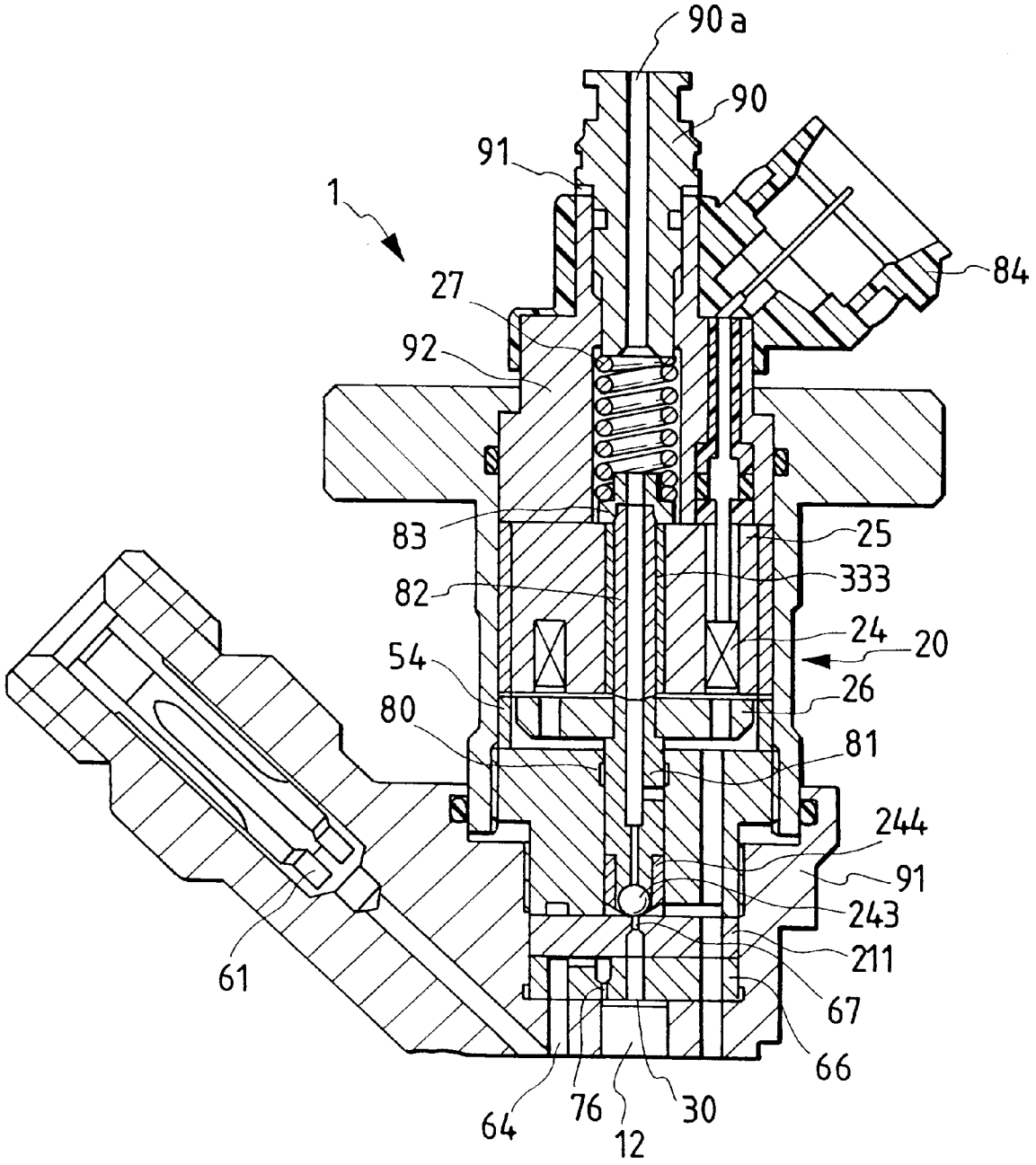
FIG. 20 is a partial cross sectional view which shows a major portion of a fuel injector according to the fifth embodiment of the invention.

FIG. 20 shows the fuel injector 1 according to the fifth embodiment of the invention. The same reference numbers as employed in the fourth embodiment refer to the same parts, and explanation thereof in detail will be omitted here.

The first orifice plate 56 has the first orifice 76 formed in a bottom surface exposed to the pressure control chamber 30. Specifically, the first orifice 76 is, unlike the fourth embodiment, exposed directly to the pressure control chamber 30, but identical in operation with the fourth embodiment.

The movable member 80 of the solenoid valve 20 includes the valve shaft 81, the hollow rod 82, the plunger 83, the ball 243, and the support 244. An assembly of the rod 82 and the plunger 83 corresponds to the plunger 242 of the fourth embodiment. The connector 84 which supplies the power to the coil 24 of the solenoid valve 20 extends diagonally up to the right in the drawing because the screw 90, as will be described in detail below, is mounted along a longitudinal center line of the solenoid valve 20.

The screw 90 is inserted into the housing 92 through the gasket 91. The amount of insertion of the screw 90 may thus be adjusted by changing the thickness of the gasket 91, which allows the spring load of the coil spring 27 acting on the plunger 83 to be regulated from outside the fuel injector 1. Specifically, the fifth embodiment is designed to change the injection characteristics easily by adjusting the thickness of the gasket 91.

Figure 21:
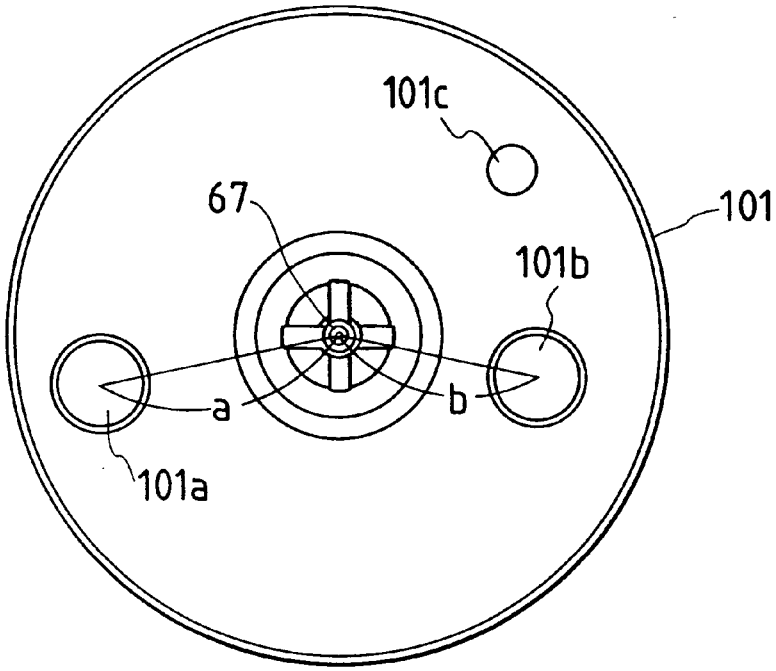
FIG. 21 is a plan view which shows a second orifice plate of a fuel injector according to the sixth embodiment of the invention.
Figure 22:
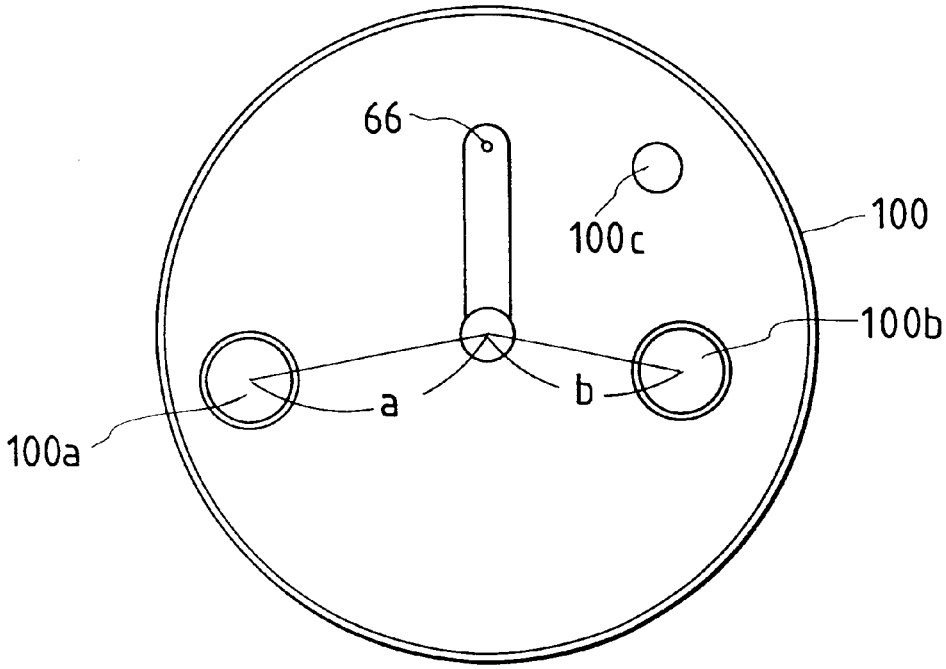
FIG. 22 is a plan view which shows a first orifice plate of a fuel injector according to the sixth embodiment of the invention.

FIGS. 21 and 22 show the sixth embodiment of the invention which is different from the above embodiments only in structure of the first and second orifice plates. Other arrangements are identical, and explanation thereof in detail will be omitted here.

The first orifice plate 100, as shown in FIG. 22, has formed therein through holes 100*a* and 100*b*. Similarly, the second orifice plate 101, as shown in FIG. 21 has formed therein through holes 101*a* and 101*b*. The through holes 100*a*, 100*b*, 101*a*, and 101*b* serve to fix angular positions of the first and second orifice plates 100 and 101 relative to the injector body 91 using knock pins.

The through holes 100*a*, 100*b*, 101*a*, and 101*b* are arranged in the first and second orifice plates 100 and 101 so as to satisfy the following two geometrical specifications:

(1) lines extending through the through holes 100*a* and 100*b* and the through holes 101*a* and 101*b* are offset from the centers of the first and second orifice plates 100 and 101, respectively (2) if intervals between the centers of the first and second orifice plates 100 and 101 and the through holes 100*a* and 101*a* are defined as a, and intervals between the centers of the first and second orifice plates 100 and 101 and the through holes 100*b* and 101*b* are defined as b, then a>b.

These specifications make it possible to fix angular positions of the fuel passages 100*c* and 100*c* when the first and second orifice plates 100 and 101 are incorporated within the injector body 91 during assembly so that the fuel passages 100*c* and 100*c* are aligned with each other. Specifically, if the first and second orifice plates 100 and 101 are placed within the injector body 91 incorrectly in angular position or one of the first and second orifice plates 100 and 101 is reversed, then the knock pins cannot be inserted into the through holes 100*a*, 100*b*, 101*a*, and 101*b*, which enables the operator to perceive that there is an error in assembly.

Each of the first and second orifice plates 100 and 101 may alternatively have formed therein three or more through holes and be designed to satisfy only the above second specification (2).

Figure 23A:
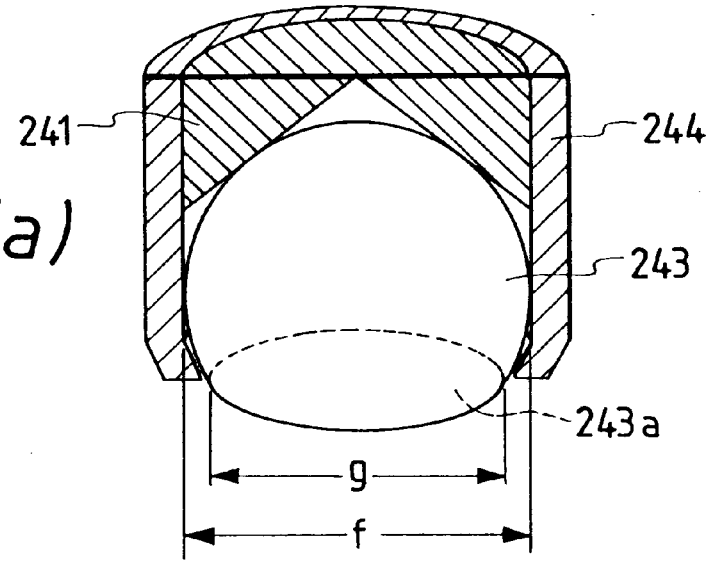
FIG. 23(*a*) is a cross sectional view which shows an end of a valve shaft of a solenoid valve of a fuel injector according to the seventh embodiment of the invention.
Figure 23B:
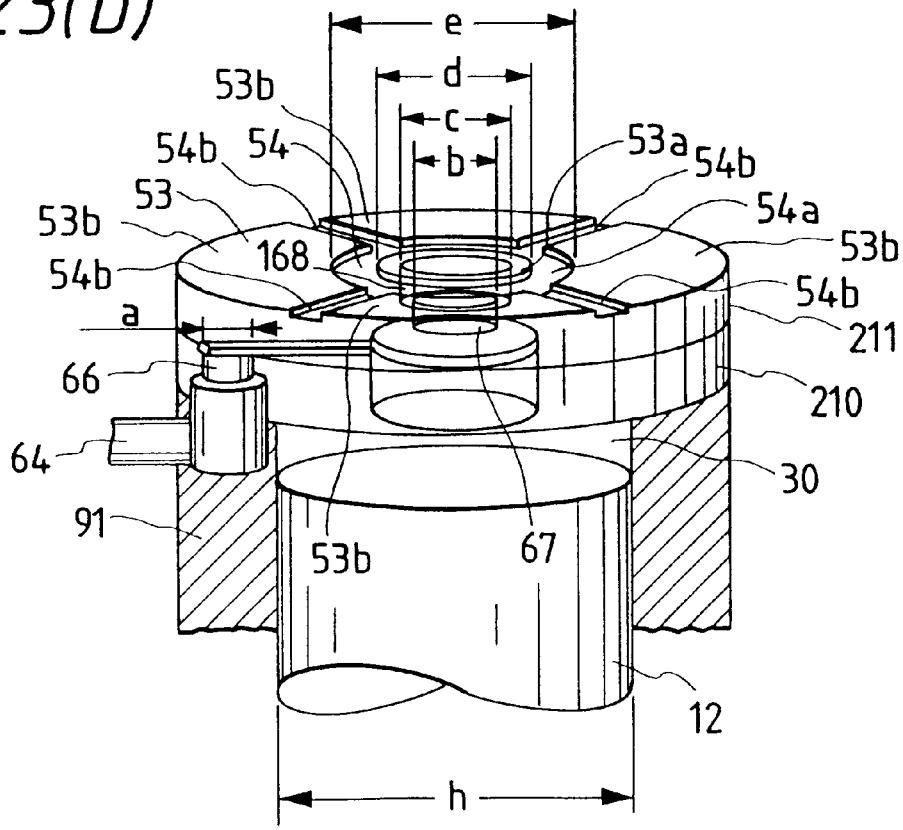

FIGS. 23(*a*) and 23(*b*) show the seventh embodiment of the invention which is different from the above embodiments in structure of the second orifice plate 211. Other arrangements are identical, and explanation thereof in detail will be omitted here. FIG. 23(*b*) shows only central portions of the first and second orifice plates 210 and 211 different from those in the above embodiments for the brevity of illustration.

The second orifice plate 211 has, as shown in FIG. 23(*b*), a cylindrical fuel chamber 168 formed in an upper surface thereof coaxially with the second orifice 67 in communication with the second orifice 67. The cylindrical fuel chamber 168 is greater in diameter, that is, smaller in flow resistance than the second orifice 67 and establishes fluid communication between the second orifice 67 and the low-pressure fuel chamber 68 when the solenoid valve 20 is turned on to lift the ball 243 upward. The cylindrical fuel chamber 168 has an opening area smaller than an area of a flat valve head 243*a* of the ball 243 of the solenoid valve 20.

The second orifice plate 211 has a flat valve seat 53 and a fuel relief path 54 formed on and in the upper surface thereof. The flat valve seat 53 consists of a central annular seat 53*a* and four fan-shaped seats 53*b* which are all engageble with the flat valve head 243*a* in surface contact. The annular seat 53*a* is formed around the periphery of the cylindrical fuel chamber 168. The fan-shaped seats 53*b* are formed at regular intervals around the annular seat 53*a*.

The fuel relief path 54 includes a central annular path 54*a* and four radially extending paths 54*b* and establishes fluid communication with the low-pressure fuel chamber 68 at all times. The annular path 54*a* is defined between an outer periphery of the annular seat 53*a* and inner peripheries of the fan-shaped seats 53*b* and coaxially with the cylindrical fuel chamber 168 for equalizing fuel pressures acting on the flat valve head 243*a* of the ball 243. The radially extending paths 54*b* are each defined between adjacent two of the fan-shaped seats 53*b* and communicate with the annular path 54*a* at angular intervals of 90°.

Formed around the fan-shaped seats 53*b* is the annular path 155, as shown in FIGS. 18(*a*) and 18(*b*), which communicates with the radially extending paths 54*b*. The annular path 155 is, as described above, provided for adding a given volume to the low-pressure fuel chamber 68 to facilitate ease of the fuel flow to the low-pressure fuel chamber 68 when the ball 243 is lifted away from the second orifice plate 211.

The seventh embodiment has the following specifications on the structural elements as shown in FIGS. 23(*a*) and 23(*b*):

1. diameter a of the first orifice 66=ϕ0.19 mm
2. diameter b of the second orifice 67=ϕ0.29 mm
3. diameter c of the cylindrical fuel chamber 168 (i.e, an inner diameter of the annular seat 53*a*)=ϕ0.4 mm
4. inner diameter d of the annular path 54*a* (i.e., an outer diameter of the annular seat 53*a*)=ϕ0.7 mm
5. outer diameter e of the annular path 54*a*ϕ=1.2 mm
6. depth of the annular path 54*a*=0.1 mm
7. width of the paths 54*b*=0.4 mm
8. depth of the paths 54*b*=0.1 mm
9. diameter f of the ball 243=ϕ2.0 mm
10. diameter g of the flat valve head 243*a*=ϕ1.63 mm
11. diameter h of the control piston 12=ϕ5.0 mm
12. stroke of the movable member 240=ϕ0.1 mm
13. diameter of the needle valve 220=ϕ4.0 mm
14. seat diameter of the needle valve 220 (i.e., the diameter of a seat area of a head of the needle valve 220 exposed to the spray hole 101*a*)=ϕ2.25 mm
15. set load of the spring 27=50 N
16. set load of the spring 223=40 N In operation of the fuel injector 1, when the coil 24 of the solenoid valve 20 is in an off-position, the plunger 242 is urged downward, as viewed in FIG. 14, by the spring pressure of the coil spring 27. The ball 243 is seated on the second orifice plate 211 to block the fluid communication between the pressure control chamber 30 and the low-pressure fuel chamber 68.

Even when the ball 243 is slightly separated from the second orifice plate 211 with an extremely small clearance of less than 1 μm causing penetration of the fuel as well as when the ball 243 is seated on the second orifice plate 211 completely, the fuel within the fuel relief path 54 is drained to the low-pressure fuel chamber 68, and the pressure thereof is kept at a low level (i.e., a drain line pressure) since the annular path 54*a* is formed around the annular seat 53*a* and communicates with the radially extending paths 54*b*. The pressure distribution between contact surfaces of the flat valve head 243*a* of the ball 243 and the annular seat 53*a* is expressed by a logarithmic function showing the point symmetry in which a peak pressure that is the pressure within the pressure control chamber 30 (i.e., the pressure within the cylindrical fuel chamber 168) is developed at the inner edge of the annular seat 53*a*, and the lowest pressure appears at the outer edge of the annular seat 53*a* that is the pressure within the radially extending paths 54*b*. If the fuel relief path 54 is not formed in the second orifice plate 211, the pressure distribution of the logarithmic function is developed over the flat valve head 243*a*, so that a greater fuel pressure acts on the ball 243 in the valve-opening direction when the solenoid valve 20 is turned off to close the second orifice 67. Specifically, the fuel relief path 54 serves to keep the fuel pressure lifting the ball 243 away from the second orifice plate 211 at low level when the solenoid valve 20 is in the off-position.

In this embodiment, the inner diameter c of the annular seat 53*a* is, as described above, 0.4 mm, and the outer diameter of the annular seat 53*a* is 0.7 mm. When the fuel pressure supplied from the common rail 141 (i.e., the pressure within the pressure control chamber 30) is 150 Mpa, the fuel pressure urging the ball 243 in the valve-opening direction will be 35 N in view of the fuel pressure distributed between the flat valve head 243*a* of the ball 243 and the annular seat 53*a* in addition to the fuel pressure within the cylindrical fuel chamber 168. The set load of the coil spring 27 is, as described above, 50 N which is greater than the fuel pressure of 35 N urging the ball 243 in the valve-opening direction. Thus, the movable member 240 is held from being lifted upward as long as the coil 24 is deenergized.

Since the diameter of the control piston 12 is 5.0 mm, the diameter of the needle valve 220 is 4.0 mm, and the seat diameter of the needle valve 220 is 2.25 mm, a pressure-energized surface of the control piston 12 is greater than that of the needle valve 220, and a difference therebetween is approximately 11 $mm^2$. The spring pressure of the coil spring 223 acts on the needle valve 220 in the spray hole-closing direction. Thus, the sum of a force acting on the control piston 12 in the spray hole-closing direction, produced by the fuel pressure within the pressure control chamber 30 and the spring pressure of the coil spring 223 is kept greater than the fuel pressure within the fuel sump 324 lifting the needle valve 220 upward as long as the coil 24 is deenergized, so that the needle valve 220 closes the spray hole 101*a*.

When the coil 24 of the solenoid valve 20 is energized, it produces an electromagnetic force of approximately 60 N attracting the armature 26, so that the sum of the electromagnetic force and the fuel pressure within the pressure control chamber 30 urging the movable member 240 in the valve-opening direction becomes greater than the spring pressure of the coil spring 27, thereby lifting the movable member 240 upward to move the ball 243 away from the second orifice plate 211. This establishes the fluid communication between the second orifice 67 and the low-pressure fuel chamber 68 so that the fuel within the pressure control chamber 30 flows into the low-pressure fuel chamber 68 through the second orifice 67.

The diameter of the cylindrical fuel chamber 168 is, as already described, greater than that of the second orifice 67, so that the flow resistance drops as the fuel flows from the second orifice 67 to the cylindrical fuel chamber 168. Therefore, even if the amount of lift of the movable member 240 is decreased below that in the above embodiments, the flow resistance of fuel flowing out of the cylindrical fuel chamber 168 may be kept smaller than that of fuel passing through the second orifice 67.

When the fuel pressure within the pressure control chamber 30 drops, and the sum of the fuel pressure within the pressure control chamber 30 urging the control piston 12 in the spray hole-closing direction and the spring pressure of the coil spring 223 becomes smaller than the fuel pressure within the fuel sump 324 lifting up the needle valve 220, it will cause the needle valve 220 to be moved away from the spray hole 101a to initiate fuel injection.

When a given injection end is reached, the coil 24 of the solenoid valve 20 is deenergized, so that the electromagnetic force attracting the armature 26 is decreased from 60 N to zero (0). This causes the movable member 240 to be moved by the spring force of the spring 27 away from the coil 24 to bring the ball 243 into engagement with the second orifice 67, thereby causing the needle valve 220 to be moved downward to close the spray hole 101*a* so that the fuel injection is terminated.

As will be apparent from the above discussion, the seventh embodiment features the formation of the cylindrical fuel chamber 168 downstream of the second orifice 67 which shows the flow resistance smaller than that of the second orifice 67. This allows the amount of lift of the movable member 240 to be decreased, thereby resulting in improved response rate and wear resistance and decrease in mechanical noise of the fuel injector 1. Specifically, a variation in amount of lift of the movable member 240 is minimized, thus reducing a variation in flow rate of fuel flowing into the low-pressure fuel chamber 68 when the solenoid valve 20 is turned on to open the spray hole 101*a*.

The seventh embodiment also features the formation of the fuel relief path 54 in the upper surface of the second orifice plate 211, which decreases the fuel pressure acting on the ball 242 of the solenoid valve 20 in the valve-opening direction when the solenoid valve 20 is turned off. This allows the spring pressure of the coil spring 27 urging the movable member 240 downward to be decreased, thereby also allowing the electromagnetic attracting force produced by the coil 24 when energized to be decreased.

The annular path 54*a* is formed in the second orifice plate 211 coaxially with the cylindrical fuel chamber 168, thereby causing the fuel pressures acting on the flat valve head 243*a* of the ball 243 in the valve-opening direction to be equalized to minimize inclination of the flat valve head 243*a* relative to the valve seat 53 of the second orifice plate 211. This allows the injection quantity to be adjusted finely.

The cylindrical fuel chamber 168 may be first drilled to guide drilling of the second orifice 67. This facilitates easy of machining of the second orifice 67.

Figure 24A:
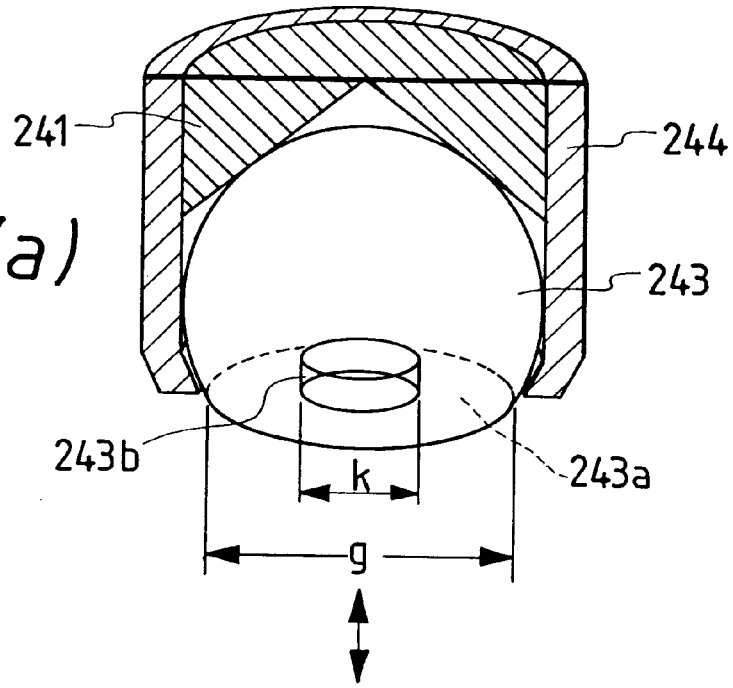
FIG. 24(*a*) is a cross sectional view which shows an end of a valve shaft of a solenoid valve of a fuel injector according to the eighth embodiment of the invention.
Figure 24B:
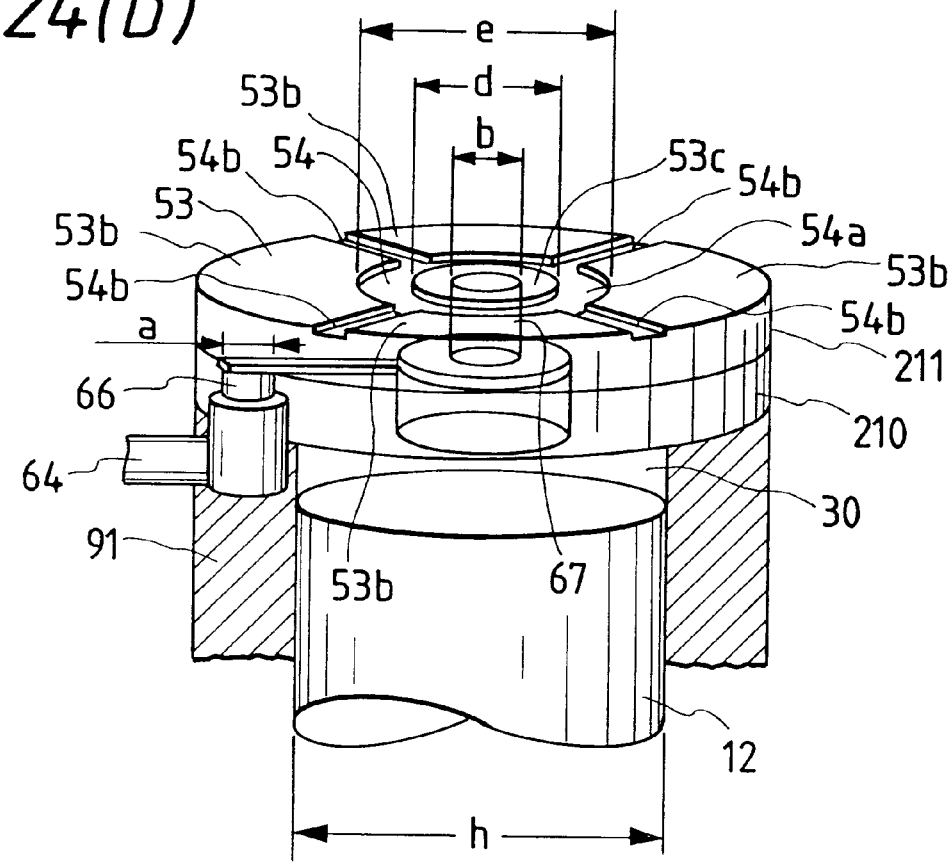

FIGS. 24(*a*) and 24(*b*) shows the eighth embodiment of the invention which is a modification of the seventh embodiment. The same reference numbers as employed in FIGS. 23(*a*) and 23(*b*) refer to the same parts.

The ball 243 has formed in the flat valve head 243*a* a central cylindrical fuel chamber 243*b* which corresponds to the cylindrical fuel chamber 168 of the fourth embodiment. The cylindrical fuel chamber 243*b* has the diameter k greater than the diameter b of the second orifice 67. In practice, the diameter k=ϕ0.4 mm, and the diameter b=ϕ0.29 mm. The other dimensions a, b, d, e, g, and h are the same as those in the fourth embodiment. An area of an opening of the cylindrical fuel chamber 243*b* is smaller than an area of the flat valve head 243*a*.

The second orifice 67 opens directly to an annular seat 53*c* formed on the upper surface of the second orifice plate 211 so that the inner diameter of the annular seat 53c is equal to the diameter b of the second orifice 67. The width of the annular seat 53*c* is greater than that of the annular seat 53*a* as shown in FIG. 23(*b*).

Since the diameter k of the cylindrical fuel chamber 243*b* is greater than the diameter b of the second orifice 67, the flow resistance of fuel flowing out of the second orifice 67 becomes smaller than when the cylindrical fuel chamber 243*b* is not formed in the flat valve head 243*a*. Specifically, the fuel flowing out of the second orifice 67, like the fourth embodiment, is not decreased in flow rate when passing between the annular seat 53*c* and the flat valve head 243*a*. This results in improved response rate and wear resistance and decrease in mechanical noise of the fuel injector 1.

The cylindrical fuel chambers 168 and 243*b*, as shown in FIGS. 23(*b*) and 24(*b*), may be of cone-shape in which the inner diameter increases as approaching the opening. The cylindrical fuel chamber 168 may also be formed in the second orifice plate 211 of the eighth embodiment, while the cylindrical fuel chamber 243*b* may also be formed in the flat valve head 243*a* of the seventh embodiment.

While the present invention has been disclosed in terms of the preferred embodiment in order to facilitate a better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An accumulator fuel injection apparatus for injecting high-pressure fuel stored within a common rail into an internal combustion engine comprising:

a valve body having formed therein a fuel inlet passage and a spray hole, wherein the fuel inlet passage communicates with the common rail;

a valve member disposed slidably within said valve body for selectively establishing and blocking fluid communication between the fuel inlet passage and the spray hole;

a pressure control chamber formed within said valve body, said pressure control chamber being connected to the fuel inlet passage to introduce therein fuel pressure which acts on said valve member to block the fluid communication between the fluid inlet passage and the spray hole;

a fuel pressure drain passage formed within said valve body, connected to said pressure control chamber for draining the fuel pressure out of said valve body;

a solenoid valve selectively establishing and blocking fluid communication between said pressure control chamber and said fuel pressure drain passage;

a first orifice plate having formed therein a first orifice which provides a first flow resistance to fuel flowing from the fuel inlet passage into said pressure control chamber; and a second orifice plate having formed therein a second orifice which provides a second flow resistance smaller than the first flow resistance to the fuel flowing out of said pressure control chamber into said fuel pressure drain passage when said solenoid valve establishes the fluid communication between said pressure control chamber and said fuel pressure drain passage, said second orifice plate being disposed on said first orifice plate so that thicknesswise directions thereof coincide with each other, wherein the first orifice has a length extending in parallel to a thickness of said first plate, and wherein the second orifice has a length extending in parallel to a thickness of said second orifice plate.

2. An accumulator fuel injection apparatus as set forth in claim 1, wherein the first and second orifices are formed by drilling said first and second orifice plates and reaming drilled holes.

3. An accumulator fuel injection apparatus as set forth in claim 1, wherein the first and second orifices are holes formed in an electron discharge method.

4. An accumulator fuel injection apparatus as set forth in claim 1, wherein the first and second orifices are polished by forcing an abrasive solution made of a mixture of liquid and abrasive grain therethrough until the flow of the abrasive solution through the first and second orifices reaches a given flow rate.

5. An accumulator fuel injection apparatus as set forth in claim 1, further comprising a first large-diameter hole having a diameter greater than that of the first orifice, said first large-diameter hole being formed in said first orifice plate coaxially with the first orifice in communication with the first orifice.

6. An accumulator fuel injection apparatus as set forth in claim 1, further comprising a second large-diameter hole having a diameter greater than that of the second orifice, said second large-diameter hole being formed in said second orifice plate coaxially with the first orifice in communication with the second orifice.

7. An accumulator fuel injection apparatus as set forth in claim 1, wherein said first and second orifice plates are so disposed within said valve body that the first orifice plate is exposed at a first surface to said pressure control chamber and at a second surface opposite the first surface in contact with a first surface of said second orifice plate, and said second orifice plate is exposed at a second surface opposite the first surface to said fuel pressure drain passage, and further comprising a cylindrical chamber formed in the second surface of said second orifice plate in communication with the second orifice, said cylindrical chamber having a diameter greater than that of the second orifice.

8. An accumulator fuel injection apparatus as set forth in claim 7, wherein said solenoid valve includes a valve head which opens and closes the second orifice to establish and block the fluid communication between said pressure control chamber and said fuel pressure drain passage, and further comprising an annular valve seat on which the valve head of said solenoid valve is to be seated to block the fluid communication between said pressure control chamber and said fuel pressure drain passage, said annular valve seat being formed on the second surface of said second orifice plate around an opening of said cylindrical chamber.

9. An accumulator fuel injection apparatus as set forth in claim 8, further comprising an annular groove formed in the second surface of said second orifice plate around said annular valve seat of said second orifice plate in fluid communication with said fuel pressure drain passage.

10. An accumulator fuel injection apparatus as set forth in claim 1, wherein said solenoid valve includes a valve head which opens and closes the second orifice to establish and block the fluid communication between said pressure control chamber and said fuel pressure drain passage, and further comprising a cylindrical chamber formed in the valve head opening to the second orifice of said second orifice plate, said cylindrical chamber having a diameter greater than that of the second orifice.

11. An accumulator fuel injection apparatus as set forth in claim 10, wherein said first and second orifice plates are so disposed within said valve body that the first orifice plate is exposed at a first surface to said pressure control chamber and at a second surface opposite the first surface in contact with a first surface of said second orifice plate, and said second orifice plate is exposed at a second surface opposite the first surface to said fuel pressure drain passage, and further comprising an annular valve seat on which the valve head of said solenoid valve is to be seated to block the fluid communication between said pressure control chamber and said fuel pressure drain passage, said annular valve seat being formed on the second surface of said second orifice plate around an opening of the second orifice.

12. An accumulator fuel injection apparatus as set forth in claim 11, further comprising an annular groove formed in the second surface of said second orifice plate around said annular valve seat of said second orifice plate in fluid communication with said fuel pressure drain passage.

13. An accumulator fuel injection apparatus for injecting high-pressure fuel stored within a common rail into an internal combustion engine comprising:

a valve body having formed therein a fuel inlet passage and a spray hole, wherein the fuel inlet passage communicates with the common rail;

a valve member disposed slidably within said valve body for selectively establishing and blocking fluid communication between the fuel inlet passage and the spray hole;

a pressure control chamber formed within said valve body, said pressure control chamber being connected to the fuel inlet passage to introduce therein fuel pressure which acts on said valve member to block the fluid communication between the fluid inlet passage and the spray hole;

a fuel pressure drain passage formed within said valve body, connected to said pressure control chamber for draining the fuel pressure out of said valve body;

a solenoid valve selectively establishing and blocking fluid communication between said pressure control chamber and said fuel pressure drain passage;

a first orifice plate having formed therein a first orifice which provides a first flow resistance to fuel flowing from the fuel inlet passage into said pressure control chamber;

a second orifice plate having formed therein a second orifice which provides a second flow resistance smaller than the first flow resistance to the fuel flowing out of said pressure control chamber into said fuel pressure drain passage when said solenoid valve establishes the fluid communication between said pressure control chamber and said fuel pressure drain passage, said second orifice plate being disposed on said first orifice plate so that thicknesswise directions thereof coincide with each other, wherein each of said first and second orifice plates is made of a disc in which first and second through holes are formed; and two knock pins inserted into said valve body through first and second through holes of said first and second orifice plates to fix angular positions of said first and second orifice plates relative to said valve body.

14. An accumulator fuel injection apparatus for injecting high-pressure fuel stored within a common rail into an internal combustion engine comprising:

a valve body having formed therein a fuel inlet passage and a spray hole, fuel inlet passage communicating with the common rail;

a valve member disposed slidably within said valve body for selectively establishing and blocking fluid communication between the fuel inlet passage and the spray hole;

a pressure control chamber formed within said valve body, said pressure control chamber being connected to the fuel inlet passage to introduce therein fuel pressure which acts on said valve member to block the fluid communication between the fluid inlet passage and the spray hole;

a fuel pressure drain passage formed within said valve body, connected to said pressure control chamber for draining the fuel pressure out of said valve body;

a solenoid valve selectively establishing and blocking fluid communication between said pressure control chamber and said fuel pressure drain passage;

a first orifice plate having formed therein a first orifice which provides a first flow resistance to fuel flowing from the fuel inlet passage into said pressure control chamber;

a second orifice plate having formed therein a second orifice which provides a second flow resistance smaller than the first flow resistance to the fuel flowing out of said pressure control chamber into said fuel pressure drain passage when said solenoid valve establishes the fluid communication between said pressure control chamber and said fuel pressure drain passage, said second orifice plate being disposed on said first orifice plate so that thicknesswise directions thereof coincide with each other; wherein each of said first and second orifice plates is made of a disc in which first and second through holes are formed; and two knock pins inserted into said valve body through first and second through holes of said first and second orifice plates to fix angular positions of said first and second orifice plates relative to said valve body, wherein the first and second through holes are formed at different intervals away from the center of each of said first and second orifice plates so that a line extending through the centers of the first and second through holes is offset from the center of each of said first and second orifice plates.

* * * * *